United States Patent [19]

Uchiyama et al.

[11] 4,315,451

[45] Feb. 16, 1982

[54] ELECTRONIC MUSICAL INSTRUMENT WITH AUTOMATIC ACCOMPANIMENT DEVICE

[75] Inventors: Yasuji Uchiyama; Akira Nakada; Akio Imamura, all of Hamamatsu, Japan

[73] Assignee: Nippon Gakki Seizo Kabushiki Kaisha, Hamamatsu, Japan

[21] Appl. No.: 114,248

[22] Filed: Jan. 22, 1980

[30] Foreign Application Priority Data

Jan. 24, 1979 [JP] Japan ..... 54-7391

[51] Int. Cl.[3] ..... G10F 1/00

[52] U.S. Cl. ..... 84/1.03; 84/DIG. 12; 84/DIG. 22

[58] Field of Search ..... 84/1.03, 1.01, DIG. 22, 84/DIG. 12, 1.24

[56] References Cited

U.S. PATENT DOCUMENTS

| | | | |
|---|---|---|---|
| 4,020,728 | 5/1977 | Robinson et al. | 84/1.03 |
| 4,112,802 | 9/1978 | Robinson et al. | 84/DIG. 22 |
| 4,120,225 | 10/1978 | Dietrich et al. | 84/DIG. 22 |
| 4,147,085 | 4/1979 | Robinson et al. | 84/1.01 |
| 4,152,965 | 5/1979 | Howell | 84/1.03 |

*Primary Examiner*—Gene Z. Rubinson
*Assistant Examiner*—Forester W. Isen
*Attorney, Agent, or Firm*—Spensley, Horn, Jubas & Lubitz

[57] ABSTRACT

An electronic musical instrument is of a key assigner type including a key coder and a channel processor, and is equipped with an automatic bass/chord performance faculty. The key coder includes a root note memory and a chord type memory, whereas the channel processor includes a key code memory and a key-on memory. The instrument is provided with a chord note memory function rendering switch and a bass note memory function rendering switch. When the chord note memory function rendering switch is turned on, the key-on memory is not cleared after release of the keys for conducting a automatic performance of chord tones. When the bass note memory function rendering switch is turned on, the root note memory and the chord type memory are not cleared after release of the keys for conducting an automatic performance of bass tones.

Thus a bass-note memorized automatic accompaniment performance and a chord-note memorized automatic accompaniment performance are independently selectable.

7 Claims, 17 Drawing Figures

ELECTRONIC MUSICAL INSTRUMENT WITH AUTOMATIC ACCOMPANIMENT DEVICE

BACKGROUND OF THE INVENTION

This invention relates to an automatic accompaniment device for an electronic musical instrument and, more particularly, to improvements in a memory function in automatic performance of chord tones and bass tones.

Known in the art of the automatic accompaniment devices for an electronic musical instrument is a technique of incorporating a memory function for repeating the automatic accompaniment performance even after release of the depressed keys which has determined the chord and the bass. According to this prior art automatic accompaniment device, if a depressed key or keys are released in a mode wherein the memory function is selected (rendered operative), chord tones and bass tones are both played automatically on the basis of the notes of the keys which has been depressed and then released. In a case where, for example, a fingered-chord function is selected as a mode of the automatic accompaniment function and the memory function is also selected (rendered operative), if a plurality of keys which have been depressed in a keyboard allotted for the automatic bass/chord performance (e.g. a lower keyboard) are released, tones of all of the keys which have been depressed before release in the keyboard for the fingered-chord automatic bass/chord performance are automatically played in the form of chord tones in accordance with a predetermined rhythm pattern and, further, bass tones are formed on the basis of the root note and the type of the chord detected in accordance with the keys which have been depressed before release in the fingered-chord automatic bass/chord performance keyboard and such bass tones are automatically played in accordance with the predetermined bass pattern.

In a case where a single-finger function is selected as a mode of the automatic accompaniment function and the memory function is also selected (rendered operative), if a single key which has been depressed in a keyboard allotted for the single-finger automatic bass/chord performance (e.g. the lower keyboard) is released in a state wherein the memory function is selected, chord tones formed on the basis of the note of the single depressed key which is used as the root note and of a chord type designated by suitable means such as depression of a white key or black key in a pedal keyboard are automatically played in accordance with a predetermined rhythm pattern and, further, bass tones formed on the basis of the root note and the chord type are automatically played in accordance with the predetermined bass pattern.

In a case where a custom function is selected as a mode of the automatic accompaniment and the memory function is also selected (rendered operative), if keys which have been depressed in the keyboards allotted for the custom function automatic bass/chord performance (i.e. the lower keyboard and the pedal keyboard) are released, tones of all the keys which have been depressed in the lower keyboard are automatically played as chord tones after release of the keys and, further, bass tones formed on the basis of the note of the single key depressed in the pedal keyboard which is used as the root note and in accordance with the chord type detected on the basis of the tones of the keys which have been depressed in the lower keyboard and with the bass pattern are automatically played. This type of prior art system is illustrated in the U.S. Pat. No. 4,184,401 to Hiyoshi et al.

The prior art automatic accompaniment device is convenient for beginners, as both chord tones and bass tones are automatically played concurrently if the memory function is selected (rendered operative). Such device however is not preferred by middle class or advanced players because a free accompaniment performance is restricted in such device. For example, there arise cases in the musical performance where the player desires to play chord tones manually while he leaves the performance of bass tones to the automatic performance using the memory function or vice versa. The prior art automatic accompaniment device, however, does not allow the player to play chord tones or bass tones alone selectively by the automatic performance using the memory function.

SUMMARY OF THE INVENTION

It is, therefore, an object of the present invention to provide an automatic accompaniment device for an electronic musical instrument capable of conducting an automatic performance using the memory functions independently for bass tones and for chord tones.

The automatic accompaniment device according to the invention is applicable to an electronic musical instrument using a key assigner system (i.e. a tone production assignment system). An outline of electronic musical instrument using the key assigner system in relation to the present invention is schematically shown in a block diagram of FIG. 1. In FIG. 1, a key assigner 2 consists of a key coder 100 and a channel processor 200. The key coder 100 detects keys which are being depressed in a keyboard 1 and generates key codes representing notes and octaves of the depressed keys. The key coder 100 also generates, in synchronization with generation of the key codes, an upper keyboard signal, a lower keyboard signal or a pedal keyboard signal which indicates that the depressed key is one in the upper keyboard, the lower keyboard or the pedal keyboard. If the automatic bass/chord performance function (i.e. the single-finger function (SF), the fingered-chord function (FC) or the custom function (CA)) is selected in a function switch section 5, the key coder 100 generates key codes designating chord tones and bass tones for the automatic bass/chord performance on the basis of the keys being depressed in the keyboard and also generates, in synchronism with generation of such key codes, a chord indication signal (a lower keyboard signal) and a bass indication signal (a pedal keyboard signal). The manner of generating key codes of chord tones and bass tones for the automatic performance differs depending upon a selected mode of the automatic bass/chord performance, i.e., the single-finger function (SF), the fingered-chord function (FC) and the custom function (CF).

If, for example, the single-finger function (SF) is selected, the note of a single key depressed in the lower keyboard is stored in a root note memory 101 whereas the chord type designated by using suitable means such as the pedal keyboard is stored in a chord type memory 102, and then a plurality of key codes of the chord tones are formed in accordance with the root note stored in the root note memory 101 and the chord type stored in the chord type memory, and key codes of the bass tones are formed in accordance with the root note stored in the root note memory 101, the chord type stored in the chord type memory 102 and a bass pattern generated by a bass pattern generator 4 according to a rhythm $R_1$-$R_n$ selected in the switch section 5.

If the fingered-chord function (FC) is selected, the key codes representing the tones of the plural keys depressed in the lower keyboard is directly used as the key codes for the chord tones, the chord type and the root note of the chord formed by plural keys depressed in the keyboard are detected from these plural keys, the chord type and the root note are stored in the chord type memory 102 and the root note memory 101 and the key codes for the bass tones are formed in accordance with the chord type stored in the chord type memory 101, the root note stored in the root note memory 101 and a bass pattern generated by the pattern generator 4.

In the custom function (CA) is selected, key codes representing a plurality of keys depressed in the lower keyboard are used as key codes for the chord tones, a note of a single key depressed in the pedal keyboard is stored in the root note memory 101, the chord type of the chord formed by the plural keys depressed in the lower keyboard is detected from these plural keys and stored in the chord type memory 102, and key codes for the bass tones are formed in accordance with the root note stored in the root note memory 101, the chord type stored in the chord type memory 102 and a bass pattern generated by the pattern generator 4.

The channel processor 200 comprises a key code memory 201 having storage positions corresponding in number to the tone production channels (e.g. 18), and a key-on memory 202. The channel processor 200 assigns the key codes generated by the key coder 100 of the depressed keys and of the chord tones and the bass tones for the automatic bass/chord performance formed on the basis of the depressed keys to one of the storage positions of the key code memory 101 for storing them and also causes a key-on signal which represents that the said key code is being generated from the key coder 100 (i.e., the key indentified by that key code is being depressed) to be stored in one of the storage positions which corresponds to the channel to which the key code has been assigned thereby to effect tone production assignment. This tone production assignment is implemented on the condition that the upper keyboard signal, the lower keyboard signal or the pedal keyboard signal is being generated by the key coder 100 and is prohibited when neither the upper keyboard signal, the lower keyboard signal nor the pedal keyboard signal is generated.

A tone generator section 3 comprises a plurality of tone generation circuits corresponding to respective tone production channels of the channel processor 200. Each of the tone generation circuit produces a tone signal designated by the key code assigned to the corresponding tone production channel. This tone signal is controlled in accordance with a key-on signal stored in the key-on memory 202 of the channel processor 200. If the automatic bass/chord function has been selected, bass tones are produced by envelope controlling tone signals for the bass performance by the key-on signals from the key-on memory 202. Chord tones are produced by envelope controlling tone signals by a chord tone generation timing signal which are generated by the pattern generator 4 and delivered from the channel processor 200 on the condition that the key-on signals (i.e. lower keyboard key-on signals) are being generated from the key-on memory 202. This chord tone generation timing signal is similar to the chord tone generation timing signal described in the specification of Japanese Patent Application No. 1978-146168 (corresponding to the co-pending U.S. application, Ser. No. 097,717 filed Nov. 27, 1979 and assigned to the same assignee as this case) entitled "Electronic musical instrument with automatic chord performance device" and detailed description thereof will be omitted.

The above is the outline of the electronic musical instrument employing the key assigner system. In the automatic accompanyment device according to the invention, the automatic performance using the memory function can be made selectively for either chord tones or bass tones. Description will now be made about a chord tone memory function (MC) and a bass tone memory function (MP).

The chord tone memory function (MC) and the bass tone memory function (MP) are selected by switching on a chord tone memory function selection switch **5*a* and a bass tone memory function selection switch 5*b* of the function switch section 5. The operation of the key assigner 2** when the chord tone memory function (MC) and the bass tone memory function (MP) are both selected (rendered operative) will now be described with respect to cases where the single-finger function (SF), the fingered-chord function (FC) and the custom function (CA) are respectively selected as the automatic bass/chord performance function.

(1) A case where the single-finger function (SF) and the chord tone memory function (MC) are selected.

If the chord tone memory function (MC) is selected, the key coder 100 produces, even after release of the depressed single key, key codes for the chord tones and key codes for the bass tones respectively for the automatic bass/chord performance in accordance with contents stored in the root note memory 101 and the chord type memory 102. In this case, chord tone signals are generated in accordance with the key codes for the chord tones, but generation of bass tone signals is prohibited. Accordingly, in the channel processor 200, the key codes concerning the chord tones only are assigned to the channels, and thus the chord tones only are automatically played. The bass tones are not automatically played.

(2) A case where the single-finger function (SF) and the bass tone memory function (MP) are selected.

If tone memory function (MP) is selected, the key coder 100 produces, as in the case where the chord tone memory function (MC) is selected, key codes for the chord tones and keys codes for the bass tones in accordance with contents stored in the root note memory 101 and the chord type memory 102 even after release of the depressed keys. In this case, bass tone signals are generated in accordance with the key codes for the bass tones, but generation of the chord tone signals is prohibited. Accordingly, the key codes corresponding to the bass tones only are assigned in the channel processor 200 and thus the bass tones only are automatically played. The chord tones are not automatically played.

(3) A case where the fingered-chord function (FC) and the chord tone memory function (MC) are selected.

The key coder 100 forms key codes for bass tones, even after release of the depressed keys, on the basis of contents stored in the root note memory 101 and the chord type memory 102 before release of the depressed keys. Since, however, generation of the bass tone signals in accordance with generation of the key codes for the bass tones is prohibited, the key codes for the bass tones are not assigned in the channel processor 200. The bass tones therefore are not automatically played. The key-on signals for the lower keyboard keys stored in the key-on memory 202 of the channel processor 200 before release of the depressed keys remain without being cleared so that the key codes for the keys which have been depressed in the lower keyboard before release thereof are processed as if the keys were not released. Accordingly, the chord tones are automatically played on the basis of the key codes stored in the key code memory 201.

(4) A case where the finger-chord function (FC) and the bass tone memory function (MP) are selected.

The key coder 100 forms, even after release of the depressed keys, key codes for bass tones on the basis of contents stored in the root note memory 101 and the chord type memory 102 before release of the keys. Bass indication signals are delivered to the channel processor 200 in synchronism with these key codes and the bass tones are automatically played. The key-on signals for the keys in the lower keyboard stored in the key-on memory 202 before release of the keys are cleared upon respective release of the keys so that the chord tones are not automatically played.

(5) A case where the custom function (CA) and the chord tone memory function (MC) are selected.

Reading of the root note memory 101 of the key coder 100 is inhibited by release of the depressed keys and key codes for the bass tones are not generated by the key coder 100. However, the key-on signals for the keys of the lower keyboard stored in the key-on memory 202 of the channel processor 200 before release of the keys are not cleared and, accordingly, the chord tones are automatically played on the basis of the key codes stored in the key code memory 201 before release of the key. In this case, although the bass tones are not played automatically, the player may depress a key in the pedal keyboard and thereby automatically play bass tones formed on the basis of the key depressed in the pedal keyboard which is used as the root note.

(6) A case where the custom function (CA) and the bass tone memory function (MP) are selected.

The key coder 100 produces, even after release of the depressed keys, key codes for bass tones and bass indication signals for bass tones on the basis of contents stored in the root note memory 101 and the chord type memory 102 before release of the keys and supplies the key codes and the bass indication signal to the channel processor 200. The channel processor 200 assigns the key codes for the bass tones to a certain tone production channel exclusive for pedal keyboard, whereby the bass tones are automatically played. Since the key-on signals of the keys in the lower keyboard which have been stored in the key-on memory 202 of the channel processor 200 are cleared, chord tones are not played automatically.

DESCRIPTION OF A PREFERRED EMBODIMENT

Figure 1:
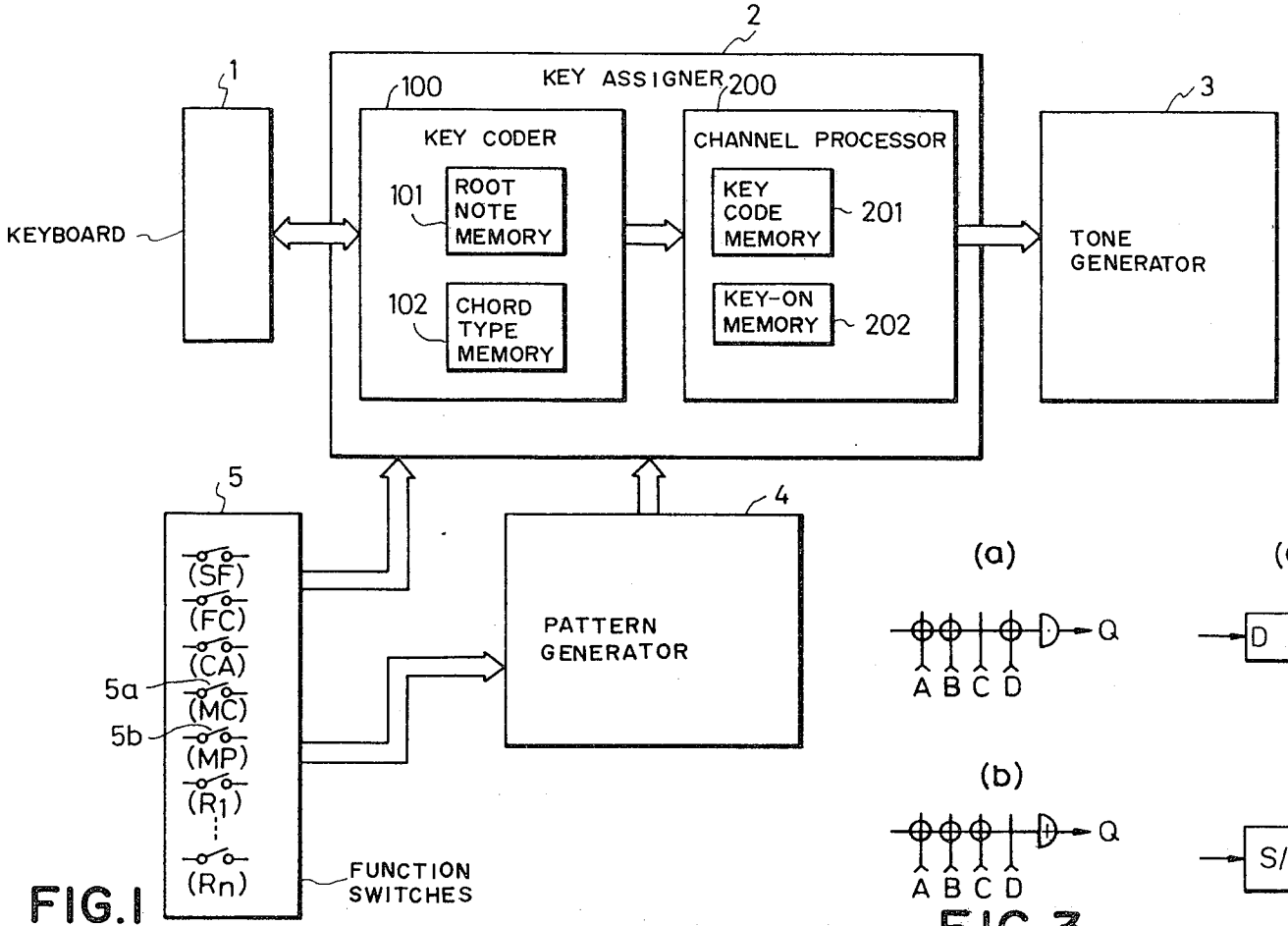
FIG. 1 is a block diagram schematically showing an automatic accompaniment device for an electronic musical instrument according to the invention.

A preferred embodiment of the automatic accompaniment device for an electronic musical instrument according to the invention will be described in detail with reference to a block diagram shown in FIG. 2 and subsequent figures.

(1) Representation of circuit elements in the drawings

Figure 3:
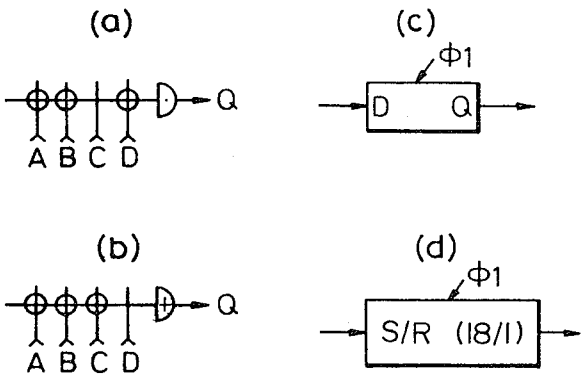
FIG. 3 is a diagram for explaining manners of representation of circuit elements employed in subsequent figures.

Special circuit elements used in the accompanying drawings are shown in FIGS. 3(*a*) to 3(*d*). FIG. 3(*a*) shows a multiple input type AND gate and FIG. 3(*b*) a multiple input type OR gate. In this way of representation, a plurality of signal lines are drawn to cross an input line of each circuit and signal lines on which an input signal is delivered to this circuit are marked with small circles at their crossing points with the input line. For example, the logical formula of FIG. 3(*a*) is $Q=A\cdot B\cdot D$ and that of FIG. 3(*b*) is $Q=A+B+C$. FIG. 3(*c*) represents a delay flip-flop and FIG. 3(*d*) a shift register. In the shift register shown in FIG. 3(*d*), the numeral before the slash represents a stage number of the shift register and the numeral after the slash represents a bit number of one stage. As shown in FIGS. 3(*c*) and 3(*d*), delay flip-flops and shift registers affixed with an arrow and a reference character $\phi 1$ are those driven by a clock pulse having a period of 1 microsecond (more precisely, of a two phase pulse) and ones which are not affixed with such an indication of the clock pulse $\phi 1$ are those driven by a clock pulse having a period of 54 microseconds.

(2) Detection of a depressed key

Figure 2:
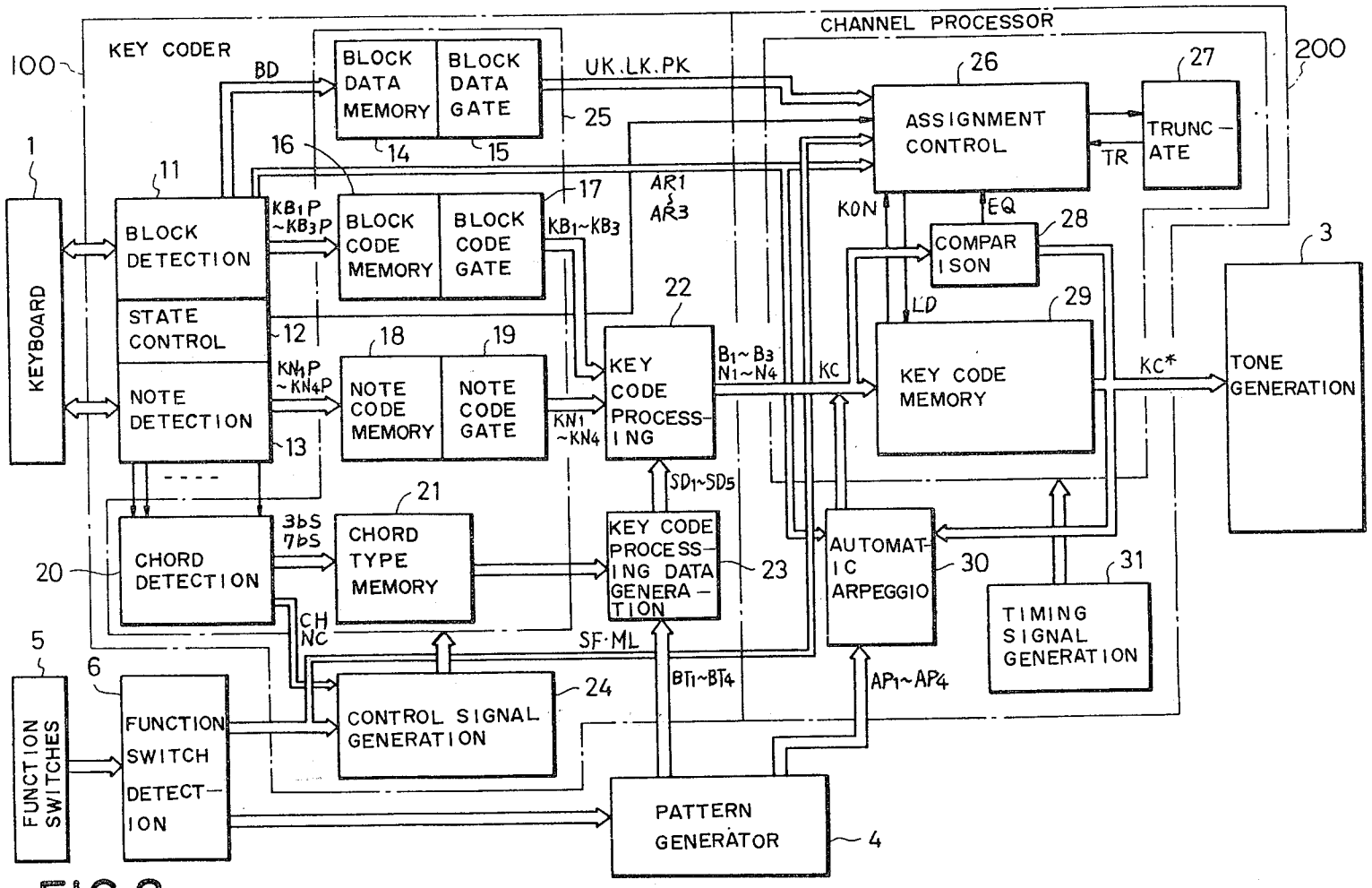
FIG. 2 is a block diagram showing an embodiment of the present invention.

Referring to FIG. 2, a key depressed in the keyboard section 1 is detected by a block detection circuit 11 and note detection circuit 13 of the key coder 100. The keyboard section 1 has an upper keyboard and a lower keyboard which respectively have 61 keys ranging from C2 of the 2nd octave to C7 of the 7th octave and a pedal keyboard which has 25 keys ranging from C2 of 2nd octave to C4 of the 4th octave. Key switches corresponding to the upper, lower and pedal keyboards are connected in a matrix fashion between row lines of block lines b1–b12 corresponding to blocks U1–U5, L1–L5 and P1, P2 which are divided by octaves and column lines of note lines n1–n13 corresponding to notes CL, C#-C (the note CL represents the lowest note C).

Figure 4:
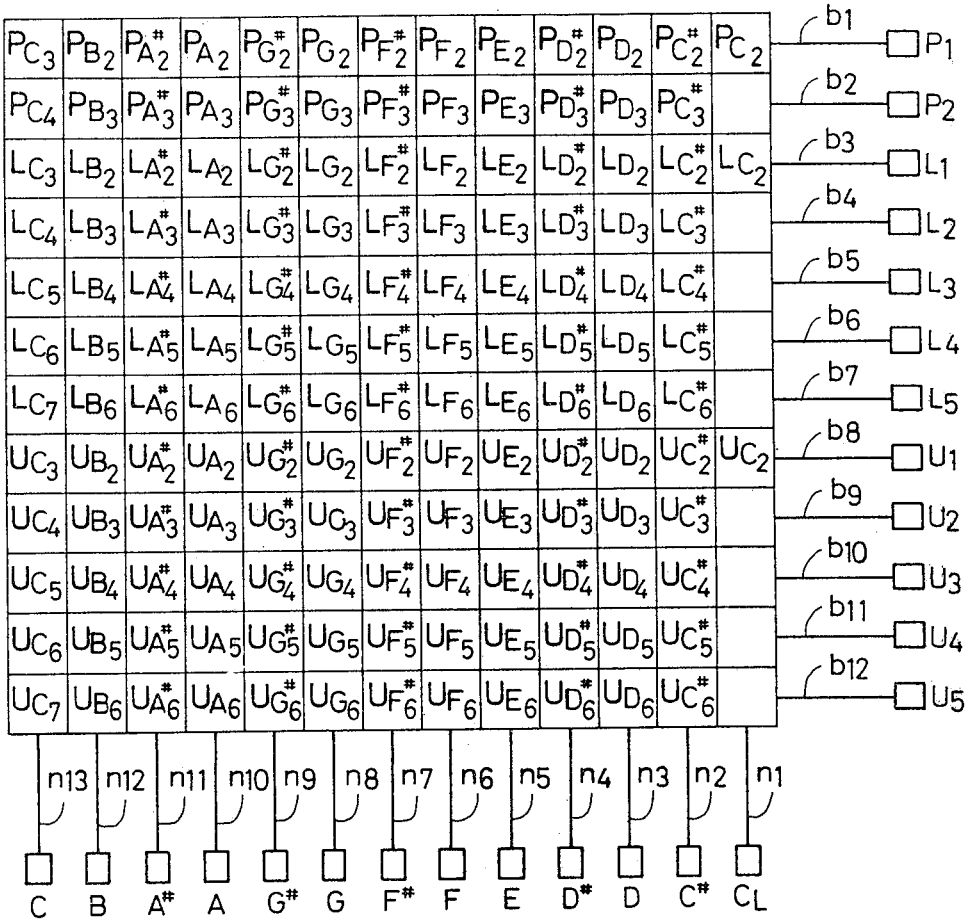
FIG. 4 is a block diagram showing an example of the keyboard section.
Figure 5:
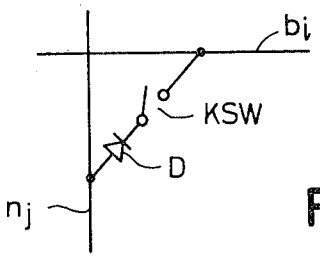
FIG. 5 is a circuit diagram showing a state of connection between block lines and note lines shown in FIG. 4 and key switches.

FIG. 4 illustrates a state of connection of the respective key switches. In FIG. 4, reference characters PC2–PC4, LC2–LC7 and UC2–UC7 in the boxes mean the respective keys and each box consists of a circuit in which each key switch KSW and a diode D connected in series are connected between a block line bi (i=1 to 12) and a note line nj (j=1 to 13) as shown in FIG. 5. For example, reference characters LD#4 means a key switch of a D# note in the 4th octave in the lower keyboard which key switch is connected on a stationary contact side to a block line b5 and on a movable contact line side to a note line n4 through a diode D.

The block detection circuit 11 and the note detection circuit 13 of the key coder 100 are controlled by the state control circuit 12 and detect key switches which are in an ON state by utilizing wiring capacity of the block line b1–b12 and the note lines n1–n13. Details of the block detection circuit 11, the note detection circuit 13 and the state control circuit 12 are shown in FIG. 6.

Figure 6:
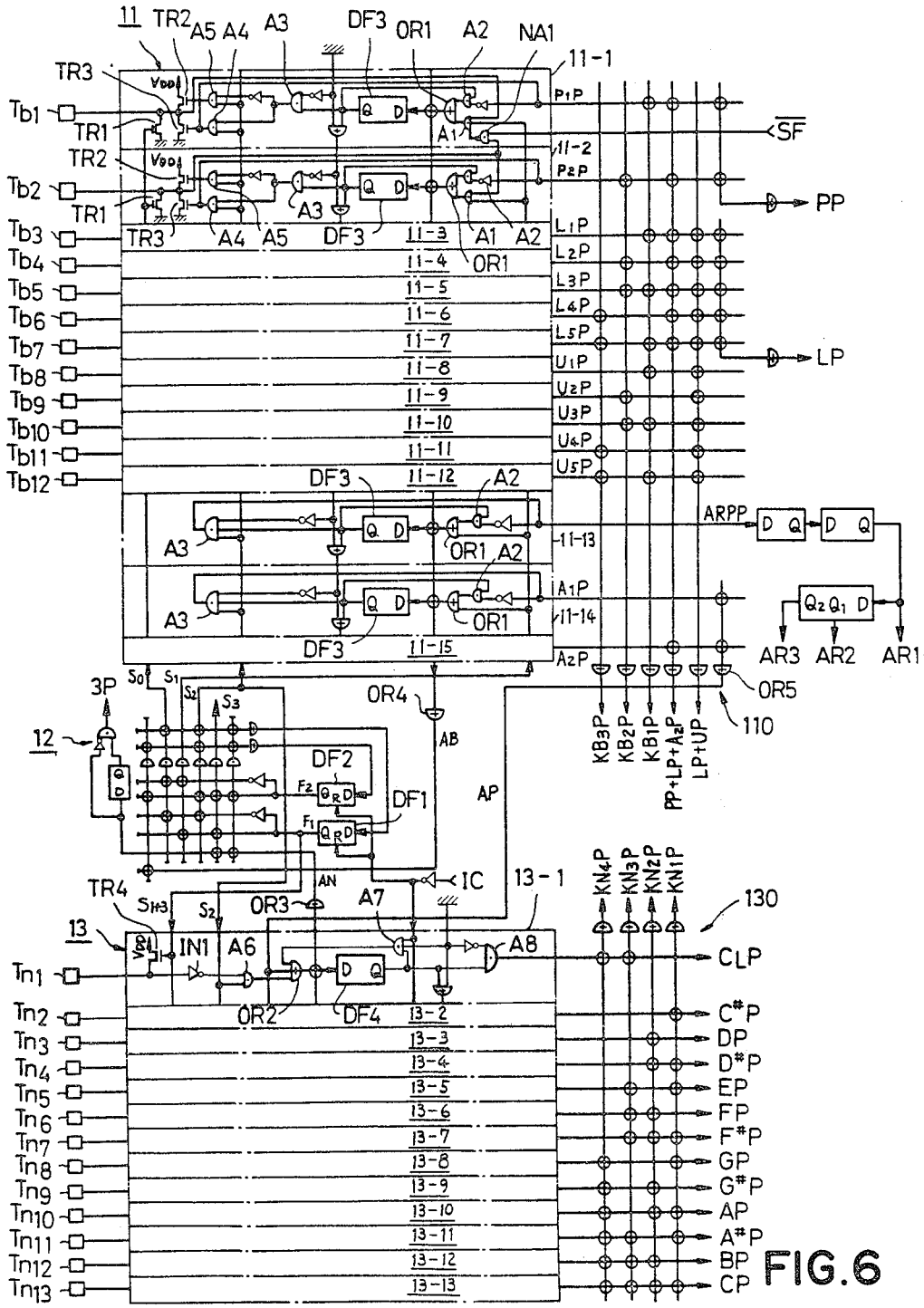
FIG. 6 is a circuit diagram showing examples of a block detection circuit, a note detection circuit and a state control circuit.

In FIG. 6, the block detection circuit 11 is connected at its terminals Tb1–Tb12 to the block lines b1–b12. The note detection circuit 13 is connected at its terminals Tn1–Tn13 to the note lines n1–n13.

The state control circuit 12 forms four states (S0)–(S3) for controlling the block detection circuit 11 and the note detection circuit 13 and generates signals S0, S1, S2 and S3 representing respective states (S0), (S1), (S2) and (S3) and a signal S1+3 representing the state (S1) or (S3). The states (S0)–(S3) formed by the state control circuit 12 are determined by outputs F1 and F2 of delay flip-flops DF1 and DF2 of the state control circuit 12. Relationship between the outputs F1 and F2 of the delay flip-flops DF1 and DF2 and the states (S0)–(S3) is shown by the following Table 1:

TABLE 1

| | F1 | F2 |
|---|---|---|
| (S0) | 0 | 0 |
| (S1) | 1 | 0 |
| (S2) | 0 | 1 |
| (S3) | 1 | 1 |

The outputs F1 and F2 of the delay flip-flops DF1 and DF2 are determined by the following logical formulas:

$$F1=(S0+S2+AN\cdot F2)' \ldots \quad (1)$$

$$F2=(S1+S2+AN\cdot F2+AB\cdot F2)' \ldots \quad (2)$$

Where (S0+S2+AN·F2)′ represents a signal produced by delaying a signal (S0+S2+AN·F2) by 54 microseconds and a signal (S1+S2+AN·F2+AB·F2)′ represents a signal produced by delaying a signal (S1+S2+AN·F2+AB·F2) by 54 microseconds. The signal AN is a signal which is turned to "0" when storage in all of the circuits 13-1 through 13-13 of the note detection circuit 13 has become "0". The signal AB is a signal which is turned to "0" when storage in all of the circuits 11-1 through 11-14 has become "0".

Figure 7:
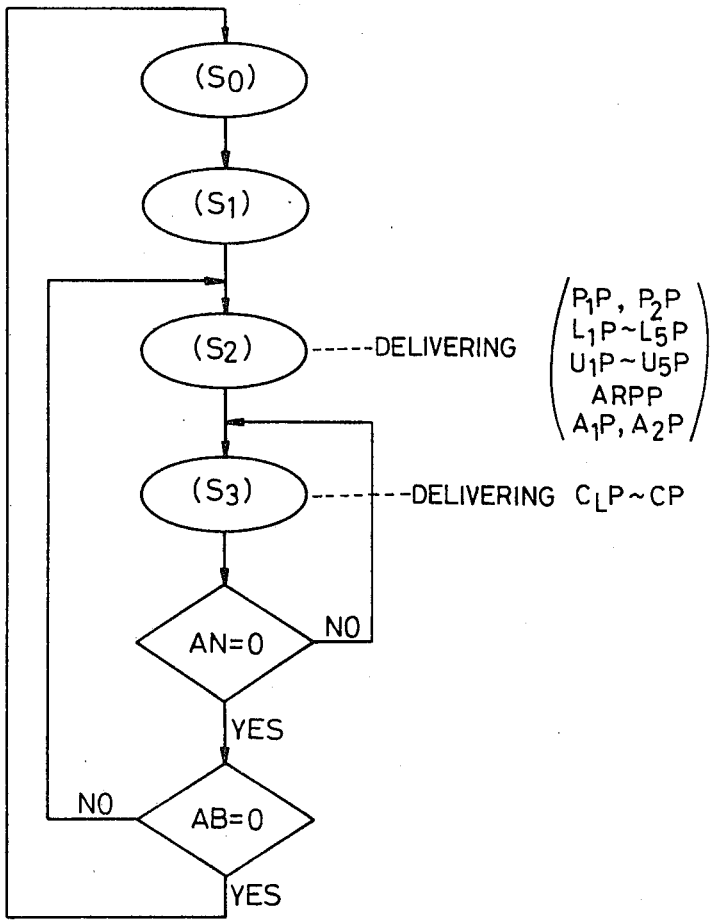
FIG. 7 is a flow chart for describing the operation of the state control circuit.

States (S0)–(S3) formed by the state control circuit 12 are shown in the flow chart of FIG. 7. In each of the states (S0)–(S3), the block detection circuit 11 and the note detection circuit 13 are controlled for detection of the depressed key in the following manner. Among the block detection circuit 11, the circuits 11-1, 11-2, 11-13 and 11-14 only are shown in detail and the circuits 11-3 through 11-12 and 11-15 are not shown in detail. The circuits 11-3 through 11-12 are of the same construction as the circuit 11-2 and the circuit 11-15 is of the same construction as the circuits 11-13 and 11-14. Throughout the respective circuits 11-1 through 11-15 of the block detection circuit 11, circuit elements of the same function are designated by the same reference characters for convenience of explanation. Among the note detection circuit 13, the circuit 13-1 only is shown. The circuits 13-2 through 13-13 are of the same construction as the circuit 13-1. In the description of the circuits 13-1 through 13-13, circuit elements of the same function are designated by the same reference characters.

(1) During the state (S0)

Transistors TR1 of the circuits 11-1 through 11-12 of the block detection circuit 11 are all brought into conduction by a signal S0 whereby all line capacities of the block lines b1-b12 are discharged. Upon lapse of 54 microseconds from rise of the signal S0 conditions of the above described logical formula (1) are satisfied and an output F1 of the delay flip-flop DF1 of the state control circuit 12 is turned to "1" and the state changes to the state (S1).

(2) During the state (S1)

Transistors TR4 of the circuits 13-1 through 13-13 of the note detection circuit 13 are brought into conduction by a signal S1+3 and all line capacities of the note lines n1–n13 are charged, whereas AND gates A1 of the circuits 11-1 through 11-12 of the block detection circuit 11 are enabled. If, accordingly, there is a block including a key switch which is in an ON state, a signal "1" is provided at all terminals among terminals Tb1–Tb12 corresponding to this block. This signal "1" is applied to a delay flip-flop DF3 through the AND gate A1 and an OR gate OR1 of a corresponding circuit and is self-held through an AND gate A2 and an OR gate OR1. In other words, the block including the key switch which is in an ON state is detected in parallel and a signal "1" is stored in the delay flip-flop DF3 of the circuit (one of the circuits 11-1 through 11-12) corresponding to this block. A priority circuit consisting of a NAND circuit $NA_1$ is inserted between the circuit 11-1 corresponding to a block P1 and the circuit 11-2 corresponding to a block P2 so that the block P2 is detected preferentially when the key switch included in the block P1 and the block P2 are in an ON state simultaneously. This priority circuit is released when the single-finger function (SF) is selected.

The signal S1 is applied to the delay flip-flop DF3 through the OR gate OR1 of one of the circuits 11-13 through 11-15 and the signal "1" is self-held through the AND gate A2 and the OR gate OR1. The circuit 11-13 is provided for securing time for carrying out processing for the automatic arpeggio performance as will be described later and the circuits 11-14 and 11-15 are provided for securing time for carrying out processing for the automatic bass/chord performance. Upon lapse of 54 microseconds the logical formula (2) is satisfied and the output of the delay flip-flop DF2 of the state control circuit 12 becomes "1" whereby the state changes to the state (S2)

(3) During the state (S2)

An AND gate A4 of one of the circuits 11-1 through 11-12 of the block detection circuit 11 which has been given the top priority among the circuits storing a signal "1" during the state (S1) (a priority circuit is composed of the AND gate A3 with the priority being given in the order of the circuit 11-1, 11-2 . . . 11-15) is enabled by the signal S2. The AND gate A2 thereby is disabled and the storage therein is cleared. The AND gate A2 delivers out a signal "1" (a pulse having a width of 54 microseconds) representing the block to which the AND gate A2 belongs (hereinafter referred to as "extracted block"). A transistor TR3 is brought into conduction by the output of the AND gate A4 thereby to discharge the line capacity of the block line corresponding to the extracted block. At this time, an AND gate A5 is enabled in the circuits other than that to which the extracted block belongs and the transistor TR2 is brought into conduction by the output of this AND gate A5 so that the line capacities of the block lines other than that for the extracted block are charged. Accordingly, a signal applied to one of terminals Tn1–Tn13 of the note detection circuit 13 corresponding to the key switch which is ON in the extracted block becomes "0". This signal "0" is inverted by an inverter In1 and thereafter is applied to a delay flip-flop DF4 through an AND gate A6 which is enabled by the signal S2 and the OR gate OR2, so that a signal "1" is self-held through an AND gate A7 and the OR gate OR2.

In sum, one of the blocks detected in the state (S1) is extracted in the state (S2) and a signal representing the extracted block delivered out while a note of the key switch which is ON in the extracted block is detected. Upon lapse of 54 microseconds after rise of the signal S2, the above described logical formulas (1) and (2) are satisfied and both of the outputs F1 and F2 of the delay flip-flops DF1 and DF2 of the state control circuit 12 are turned to "1" whereby the state changes to the state (S3).

(4) During the state (S3)

An AND gate A8 of one of the circuits 13-1 through 13-13 of the note detection circuit 13 which has been given the top priority (a priority circuit is composed of an AND gate A8 and priority is given in the order of the circuit 13-1, 13-2 . . . 13-13) among the circuits storing a signal "1" in the state (S2) is enabled and delivers out a signal "1" representing the key switch which is ON (a pulse having a width of 54 microseconds). The AND gate A7 is disabled and the storage therein is cleared.

If an output of an OR gate OR3 to which outputs of the OR gates OR2 of the circuits 13-1 through 13-13 of the note detection circuit 13 are applied (i.e., an output which is "0" when storage in the respective circuits 13-1 through 13-13 of the note detection circuit 13 is all cleared and is referred to as "any-note signal AN") is "1" in the state S3, the logical formulas (1) and (2) are both satisfied and the outputs F1 and F2 of the delay flip-flops DF1 and DF2 of the state control circuit 12 are both turned to "1" and the state (S3) is resumed.

In this manner, in the state (S3), signals representing notes of all key switches that are ON in the extracted block are sequentially outputted from the lowest note side.

In the state (S3), if an output of an OR gate OR4 to which outputs of the OR gates OR1 of the circuits 11-1 through 11-15 of the block detection circuit 11 are applied (i.e. a signal which is "0" when storage in the respective circuits 11-1 through 11-15 is all cleared and is referred to as "any-block dignal AB") is "1", the logical formula (2) is satisfied notwithstanding that the any-note signal AN is "0". The state returns to the state (S2) and the operation in the state (S2) is performed.

Thus, the state (S2) and the state (S3) are repeated alternately until the any-block signal AB becomes "0", the signal representing the extracted block being outputted in the state (S2) and the signals representing the notes of the key switches which are ON in the extracted block being outputted in the state (S3).

Upon completion of extraction of all of the signals stored in the circuits 11-1 through 11-12 of the block detection circuit 11 in the state (S1), the AND gate A3 of the circuit 11-13 is enabled in the state (S2) so that the contents stored in the circuit 11-13 are extracted and a signal "1" is outputted. The signal "1" (a pulse having a pulse width of 54 microseconds) is delayed by a delay flip-flop as illustrated in the figure and thereafter is outputted as an arpeggio signal Ar1–AR3 which is used for data processing for the automatic arpeggio performance in the channel processor 200 to be described later.

As the storage in the circuit 11-13 of the block detection circuit 11 has been extracted and the operation mode returns to the state (S2) through the state (S3), the AND gate A3 of the circuit 11-14 of the block detection circuit 11 is enabled to gate out a signal "1". This signal "1" is applied to the OR gates OR2 of the circuits 13-1 through 13-13 of the note detection circuit 13 through an OR gate OR5 thereby to cause the circuits 11-1 through 11-13 to store a signal "1". Accordingly, the signals CLP-CP representing the notes $C_L$-C are sequentially outputted from the circuits 13-1 through 13-13 of the note detection circuits 13 in the next state (S3). When the outputting of the signals CLP-CP has ceased and the any-note signal AN has become "0", the operation mode changes to the state (S2) and the storage in the circuit 11-15 of the block detection circuit 11 is extracted. Accordingly, a signal "1" is outputted from the circuit 11-15. This signal "1" is applied to the OR gates OR2 of the circuits 13-1 through 13-13 of the note detection circuit 13 in the same manner of the output of the circuit 11-14 so that signals representing the respective notes CL-C are sequentially outputted from the circuits 13-1 through 13-13 in the next state (S3). These signals representing the notes CL-C outputted from the circuits 13-1 through 13-13 of the note detection circuit 13 by extraction of the storage in the circuits 11-14 and 11-15 of the block detection circuits 11 are used for forming data for the automatic bass/chord performance to be described later.

Upon completion of the extraction of the storage in the circuits 11-1 through 11-15 of the block detection circuit 11 and delivery of the storage in the circuits 13-1 through 13-13 of the note detection circuit 13, the any-block signal AB and the any note signal AN are both turned to "0". The operation mode thereby returns to the state (S0) and one cycle of the key switch scanning operation is completed.

Figure 8:
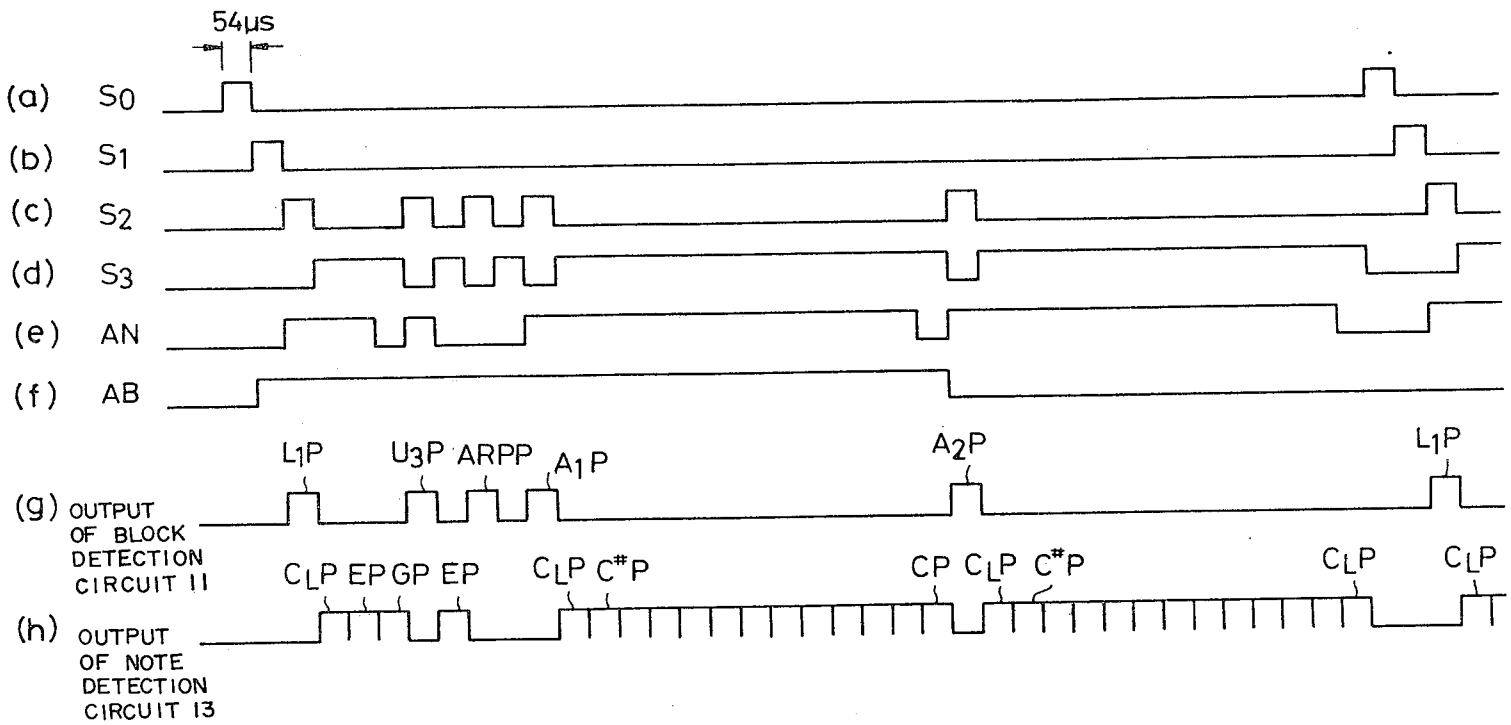
FIGS. 8(*a*)–8(*h*) are time charts showing signals appearing in respective portions of the block detection circuit, the note detection circuit and the state control circuit shown in FIG. 6.

If, for example, a key for note E of the 4th octave (i.e., E4) which corresponds to UE4 in FIG. 4 is depressed in the upper keyboard and keys for notes C, G and E of the 2nd octave (i.e. LC2, LG2 and LE2 in FIG. 4) are depressed in the lower keyboard, the outputs of the note detection circuit 11 and the note detection circuit 13 in relation to the states (S0)-(S3) are shown in the time chart of FIG. 8. FIGS. 8(*a*)-8(*d*) show signals S1-S3 representing the states (S0)-(S3), 8(*e*) the any-note signal AN, 8(*f*) any-block signal AB, 8(*g*) the outputs of the circuits 11-1 through 11-15 of the block detection circuit 11 and 8(*h*) the outputs of the circuits 13-1 through 13-13 of the note detection circuit 13.

Signals P1P, P2P, L1P-L5P and U1P-U5P representing extracted blocks and being outputted from the circuits 11-1 through 11-12 of the block detection circuit 11 are encoded into signals KB1P-KB3P which represent 3-bit block codes KB1-KB3. RElationship between the blocks P1-U5 and the block codes KB1-KB3 is shown in Table 2.

TABLE 2

| block | block code | | |
|---|---|---|---|
| | KB3 | KB2 | KB1 |
| P1 | 0 | 0 | 1 |
| P2 | 0 | 1 | 0 |
| L1 | 0 | 0 | 1 |
| L2 | 0 | 1 | 0 |
| L3 | 0 | 1 | 1 |
| L4 | 1 | 0 | 0 |
| L5 | 1 | 0 | 1 |
| U1 | 0 | 0 | 1 |
| U2 | 0 | 1 | 0 |
| U3 | 0 | 1 | 1 |
| U4 | 1 | 0 | 0 |
| U5 | 1 | 0 | 1 |

An encoder 110 produces a signal PP which represents that the blocks P1 and P2 including keys of the pedal keyboard are being extracted, a signal LP which represents that the blocks L1-L5 including keys of the lower keyboard are being extracted, a signal PP+LP+A2P which represents that the blocks P1 and P2 including keys of the pedal keyboard, the blocks L1-L5 including keys of the lower keyboard or the storage in the circuit 11-15 is being extracted, and a signal LP+UP which represents that the blocks L1-L5 including keys of the lower keyboard or the blocks U1-U5 including keys of the upper keyboard are being extracted.

The signals CLP-CP representing thd notes CL-C outputted from the circuits 13-1 through 13-13 of the note detection circuit 13 are encoded into signals KN1P-KN4P representing 4-bit note codes KN1-KN4. Relationship between the respective notes and the note codes KN1-KN4 is shown in Table 3.

The abovementioned type of depressed key detection is disclosed in the specification of U.S. Pat. No. 4,148,017 to Tomisawa.

TABLE 3

| note | note code | | | | decimal representation |
|---|---|---|---|---|---|
| | KN4 | KN3 | KN2 | KN1 | |
| CL | 1 | 1 | 0 | 0 | 12 |

TABLE 3-continued

| note | note code | | | | decimal representation |
|---|---|---|---|---|---|
| | KN4 | KN3 | KN2 | KN1 | |
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

(3) Operation of the key coder 100 when the automatic bass/chord function is not selected If none of the single-finger function (SF), the fingered-chord function (FC) and the custom function (CA) is selected, the key coder 100 forms, responsive to outputs of the block detection circuit 11 and the note detection circuit 13, key codes KC (B1-B3, N1-N4) representing the octave and note of the depressed key and the upper keyboard signal UK, lower keyboard signal LK or pedal keyboard signal PK indicating that the depressed key is one in the upper keyboard, lower keyboard or pedal keyboard and supplies this signal to the channel processor 200.

If any key in the upper keyboard, the lower keyboard or the pedal keyboard is depressed in the keyboard section (FIG. 2), the block detection circuit 11 of the key coder 100 produces a signal representing the block including the depressed key in the state (S2) and the note detection circuit 13 produces a signal representing the note of the depressed key. More specifically, the signal representing the block of the depressed key outputted from the block detection circuit 11 in the state (S2) consists of block data BD representing which of the upper keyboard, the lower keyboard or the pedal keyboard the depressed key belongs to (in the present embodiment, the signal PP+LP+A2P, LP+UP and AP shown in FIG. 6 are used and the upper keyboard signal UK, the lower keyboard signal LK and the pedal keyboard signal PK are formed from these signals as will be described later) and the signal KB1P-KB3P representing the octave of the depressed key, whereas the signals delivered from the note detection circuit 13 in the state (S3) is the signal KN1P-KN4P representing the note of the depressed key. The block data BD and the signal KB1P-KB3P representing the block code delivered from the block detection circuit 11 in the state (S2) are applied to the block data memory 14 (FIG. 2) and the block code memory 16 (FIG. 2) and held therein during the state (S3) for matching the timing with the signal KN1P-KN4P representing the note code which is delivered from the note detection circuit 13 during the state (S3).

A block data gate circuit 15 produces, in accordance with the block data held in the block data memory 14 during the state (S3), the upper keyboard signal UK, the lower keyboard signal LK or the pedal keyboard PK representing which of the upper keyboard, the lower keyboard and the pedal keyboard the depressed key belongs and supplies the signal UK, LK or PK to the channel processor 200.

Figure 9:
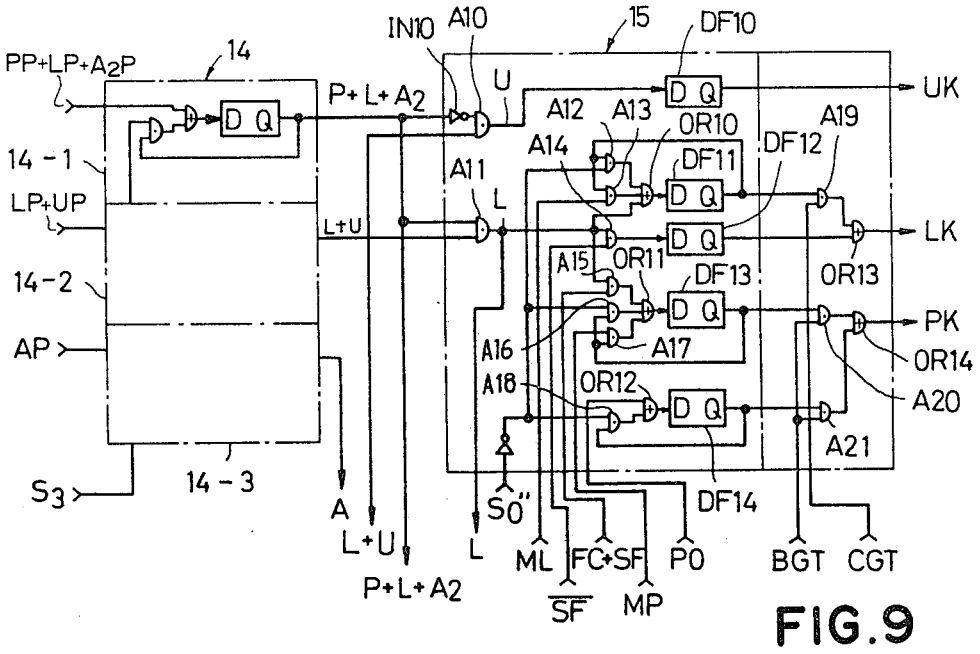
FIG. 9 is a circuit diagram showing examples of a block data memory and a block data gate.

FIG. 9 shows examples of the block data memory 14 and the block data gate circuit 15. The block data memory 14 which consists of a 3-stage register stores the block data BD (i.e., the signals PP+LP+A2P, LP+UP and AP) applied from the block detection circuit 11 in its respective stages 14-1 through 14-3 and holds the block data BD during the state (S3). The circuit construction of the block data memory 14 is shown in detail with respect only to the stage 14-1 but the stages 14-2 and 14-3 are of the same construction as the stage 14-1.

Output signals P+L+A2 and L+U of the stages 14-1 and 14-2 of the block data memory 14 which hold the signals PP+LP+A2P and LP+UP during the state (S3) are applied to the block data gate circuit 15. In the block data gate circuit 15, the upper keyboard signal U is formed by ANDing through an AND gate A10 a signal obtained by inverting the signal P+L+A2 by an inverter I10 and the signal L+U and the lower keyboard signal L is formed by ANDing through an AND gate A11 the signal P+L+A2 and the signal L+U. Alternatively stated, the AND gate A10 is enabled when the depressed key belongs to the upper keyboard and the output of the AND gate A10 is supplied as the upper keyboard signal UK to the channel processor 200 through a delay flip-flop DF10. The AND gate A11 is enable when the depressed key belongs to the lower keyboard and the output of the AND gate A11 is supplied as the lower keyboard signal LK to the channel processor 200 through an AND gate A14 which is enabled if the automatic bass/chord function is not selected, a delay flip-flop DF12 and an OR gate OR13.

If the depressed key belongs to the pedal keyboard, processing is carried out in a different manner from the above described ones. This is because processing made in the note code memory 18 (FIG. 2 and FIG. 11) is different in a case where the signal KN1P–KN4P representing the note delivered from the note detection circuit 13 is one for a key of the pedal keyboard from a case where the signal KN1P–KN4P is one for a key of the upper keyboard or the lower keyboard. More specifically, when the signal KN1P–KN4P outputted from the note detection circuit 13 is one for a key of the pedal keyboard, this signal KN1P–KN4P is once stored in the note code memory 18 and then read out at a next timing (state (S3)) at which the storage of the circuit 11-5 of the block detection circuit 11 is extracted from a note code gate circuit 19 (FIG. 2 and FIG. 11) and the signal A2P thereby is generated. Accordingly, the pedal keyboard signal PK which represents that the depressed key belongs to the pedal keyboard must be synchronized with the timing of this signal read from the note code memory 18.

The pedal keyboard signal PK indicating that the depressed key belongs to the pedal keyboard is formed in accordance with a signal P0 which is generated by the control signal generation circuit 24 to be described later (FIGS. 2 and 4). This signal P0 is a signal which rises, under the condition that the finger chord function (FC) and the single finger function (SF) are not selected, at the rising of state (S3) when the block P1 or P2 including the key of the pedal keyboard is being extracted in the block detection circuit 11 (i.e., the rising of the signal 3p generated from the state control circuit 12 shown in FIG. 6) and falls at the timing when the signal A2P is delivered from the circuit 11-15 of the block detection circuit 11. The signal P0 generated by the control signal generation circuit 24 is applied to a delay flip-flop DF14 through an OR gate OR12 (FIG. 9) and, after being delayed by 1 bit time (54 microseconds) by the delay flip-flop DF14, is supplied to an AND gate A21. The AND gate A21 receives at the other input thereof a bass tone gate timing signal BGT to be described later. This bass tone gate timing signal BGT is turned to "1" one bit time after satisfaction of the logical formula $\overline{(FC+SF)}\cdot P0\cdot A2P$. This enables the AND gate A21 to gate out a signal "1" which is applied to the channel processor 200 as the pedal keyboard signal PK through an OR gate OR14.

The block code gate circuit 17 receives the output of the block code memory 16 and thereupon forms the block code KB1–KB3 representing the octave of the depressed key.

Figure 10:
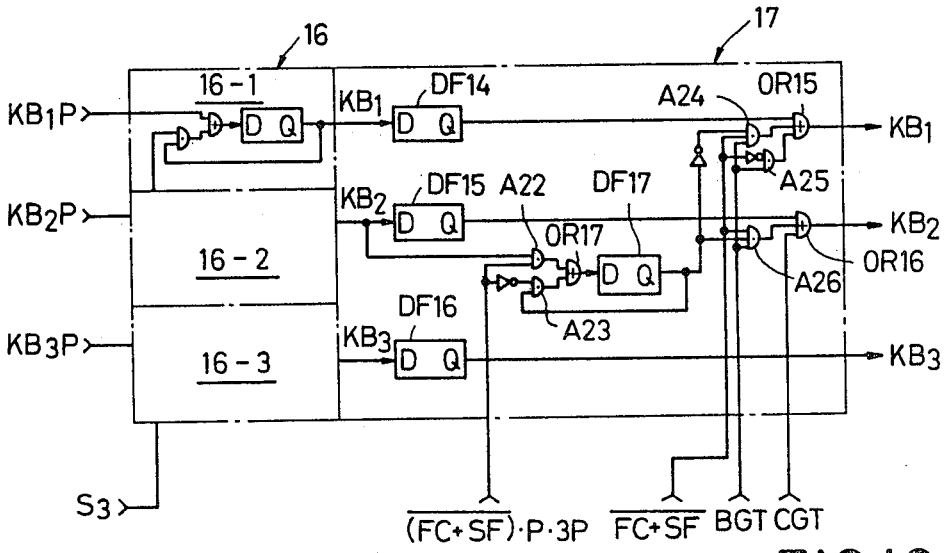
FIG. 10 is a circuit diagram showing examples of a block code memory and a block code gate.

FIG. 10 shows examples of the block code memory 16 and the block code gate circuit 17. The block code memory 16 stores the signal KB1P–KB3P representing the octave of the depressed key applied from the block detection circuit 11 in the state (S2) and hold this signal KB1P–KB3P during the state (S3) responsive to the signal S3. A stage 16-1 of the block code memory 16 which corresponds to the signal KB1P only is shown in detail but other stages 16-2 and 16-3 corresponding to the signals KB2P and KB3P are of the same construction at the stage 16-1. The signal KB1–KB3 which is outputted from the respective stage 16-1 through 16-3 of the block code memory 16 in the state (S3) is applied to the block code gate circuit 17. The block code gate circuit 17 causes the applied signal KB1–KB3 to be delayed by one bit time (54 microseconds) by delay flip-flops DF14–DF16 and thereafter outputs it through OR gate OR15 and OR16 or directly. If the signal KB1P–KB3P held in the block code memory 16 is for a key of the pedal keyboard, processing which is different from the above described processing is effected. This is because, as was previously described, the signal KN1P–KN4P for a key of the pedal keyboard is held until the timing of the bass tone gate timing signal BGT in the note code memory 18. When the signal KB1–KB3 outputted from the block code memory 16 in the state (S3) is for a key of the pedal keyboard, an AND gate A22 of the block code gate circuit 17 is enabled at the rising portion of the state (S3) (i.e., timing of the signal 3P) and the output of the state 16-2 of the block code memory 16 thereby is applied to a delay flip-flop DF17 through the AND gate A22 and the OR gate OR17 and is self-held through an AND gate A23 and the OR gate OR17. There are blocks P1 and P2 which include keys of the pedal keyboard. As shown in table 2, the block code KB3–KB1 of the block P1 is "001", and the block code KB3–KB1 of the block P2 "010". Accordingly, in the block code gate circuit 17, the signal KB2 in the block code KB1–KB3 is one for a key of the pedal keyboard and a signal "001" is delivered as the block code KB3–KB1 at the timing of the signal BGT when the signal KB2 is "0" whereas a signal "010" is outputted as the block code KB3–KB1 when the signal KB2 is "1". A signal obtained by inverting the output of the delay flip-flop DF17 by an inverter is applied to an AND gate A24 and the output of the delay flip-flop DF17 is applied to an AND gate A26. The AND gates A24 and A26 are enabled at the timing of the signal BGT if neither the finger chord function (FC) nor the single finger function (SF) has been selected (i.e., the signal $\overline{FC+SF}$="0"). Accordingly, the AND gates A24 and A26 supply the inverted output of the delay flip-flop DF17 and OR16 at the timing of the signal BGT and causes them to be outputted therefrom as the signals KB1 and KB2. Since the storage in the circuit 11-15 of the block detection circuit 11 is extracted at the timing of the signal BGT and the signal KB3 therefore is "0", the output KB3-KB1 of the block code gate circuit 17 is "001" indicating the block P1 if the output of the delay flip-flop DF17 is "0", i.e., the signal KB2 is "0". If the output of the delay flip-flop DF17 is "1", i.e., the signal KB2 is "1", the output KB3-KB1 of the block gate circuit 17 is "010" indicating the block P2.

Figure 11:
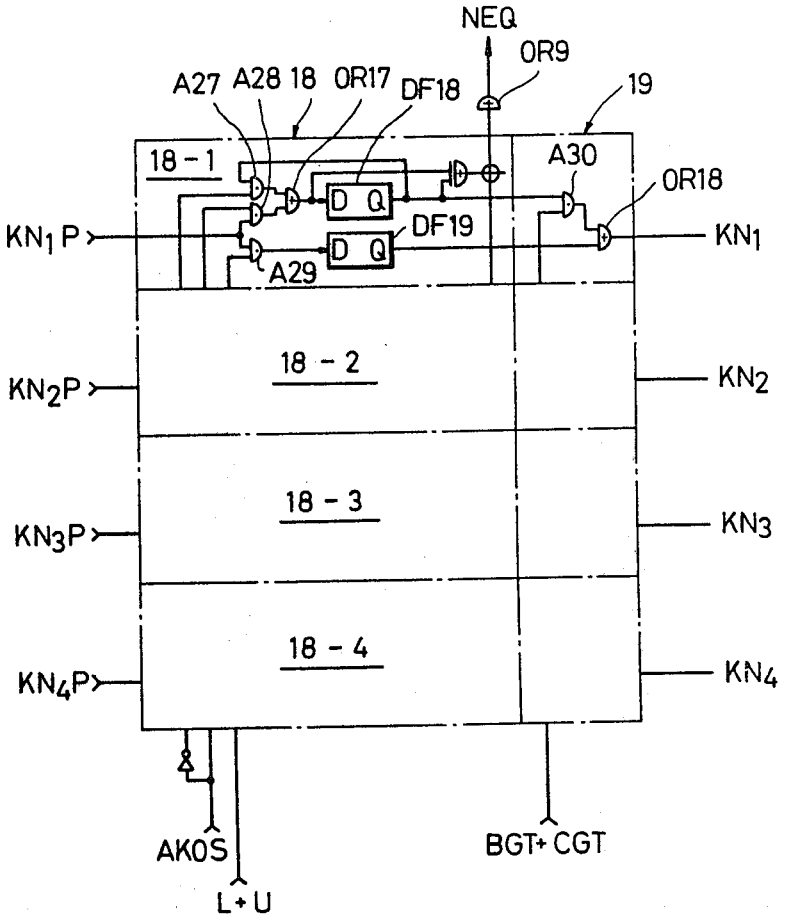
FIG. 11 is a circuit diagram showing examples of a note code memory and a note code gate.

The signal KN1P-KN4P representing the note of the depressed key outputted from the note detection circuit 13 in the state (S3) is applied to the note code memory 18 (FIGS. 2 and 11). The note code memory 18 performs different operations depending upon whether the signal KN1P-KN4P applied thereto is one for a key of the pedal keyboard. If the signal KN1P-KN4P is one for a key of the upper or lower keyboard, this signal is outputted after being delayed by only 1 bit time (54 microsecond) whereas if the signal KN1P-KN4P is one for a key of the pedal keyboard, this signal is held and thereafter is delivered from the note code gate circuit 19 (FIGS. 2 and 11) at the timing of the signal BGT.

FIG. 11 shows examples of the note code memory 18 and the note code gate circuit 19. The note code memory 18 consists of four stages and each of the four stages 18-1 through 18-4 has two memory positions consisting of delay flip-flops DF18 and DF19, as representably show in the stage 18-1. If the signal KN1P-KN4P applied to the stages 18-1 through 18-4 of the note code memory 18 is one for a key of the upper keyboard or the lower keyboard, AND gates A29 of the respective stages 18-1 through 18-4 are enabled by the signal L+U (the output of the stage 14-2 of the block data memory 14 shown in FIG. 9), the applied signal KN1P-KN4P being outputted from the OR gate OR18 through the AND gate A29 and the delay flip-flop DF19. If, accordingly, the signal KN1P-KN4P applied to the note code memory 18 is one for a key of the upper keyboard or the lower keyboard, the signal KN1P-KN4P is delivered from the note code gate circuit 19 after being delayed by only 1 bit time (54 microseconds).

If the signal KN1P-KN4P applied to the note code memory 18 is one for a key of the pedal keyboard, the AND gates A29 of the stages 18-1 through 18-4 of the note code memory 18 are disabled and AND gates A28 are enabled by a signal AKOS. The applied signal KN1P-KN4P therefore is applied to the delay flip-flop DF18 through the AND gate A27 and the OR gate OR17 and is self-held through the AND gate A27 and the OR gate OR17. The signal AKOS is a signal which becomes "1" when a block (P1 or P2) including a key of the pedal keyboard is extracted in the block detection circuit 11 and at the fall portion of the state (S3) (i.e., at the timing of the signal 3P) under the condition that the automatic bass/chord function has not been selected. The signal self-held in the delay flip-flop DF18 through the AND gate A27 and the OR gate OR17 is not cleared until the block (P1 or P2) including a key of the pedal keyboard is extracted in a next scanning time and the signal AKOS becomes "1" again. The output of the delay flip-flop DF18 is applied to an AND gate A30 of the note code gate circuit 19. The AND gate A39 is so arranged that it will be enabled by the signal BGT and, accordingly, the note code KN1-KN4 for the key of the pedal keyboard stored in the delay flip-flop DF18 is outputted through the OR gate OR18 at the timing of the signal BGT.

Figure 12:
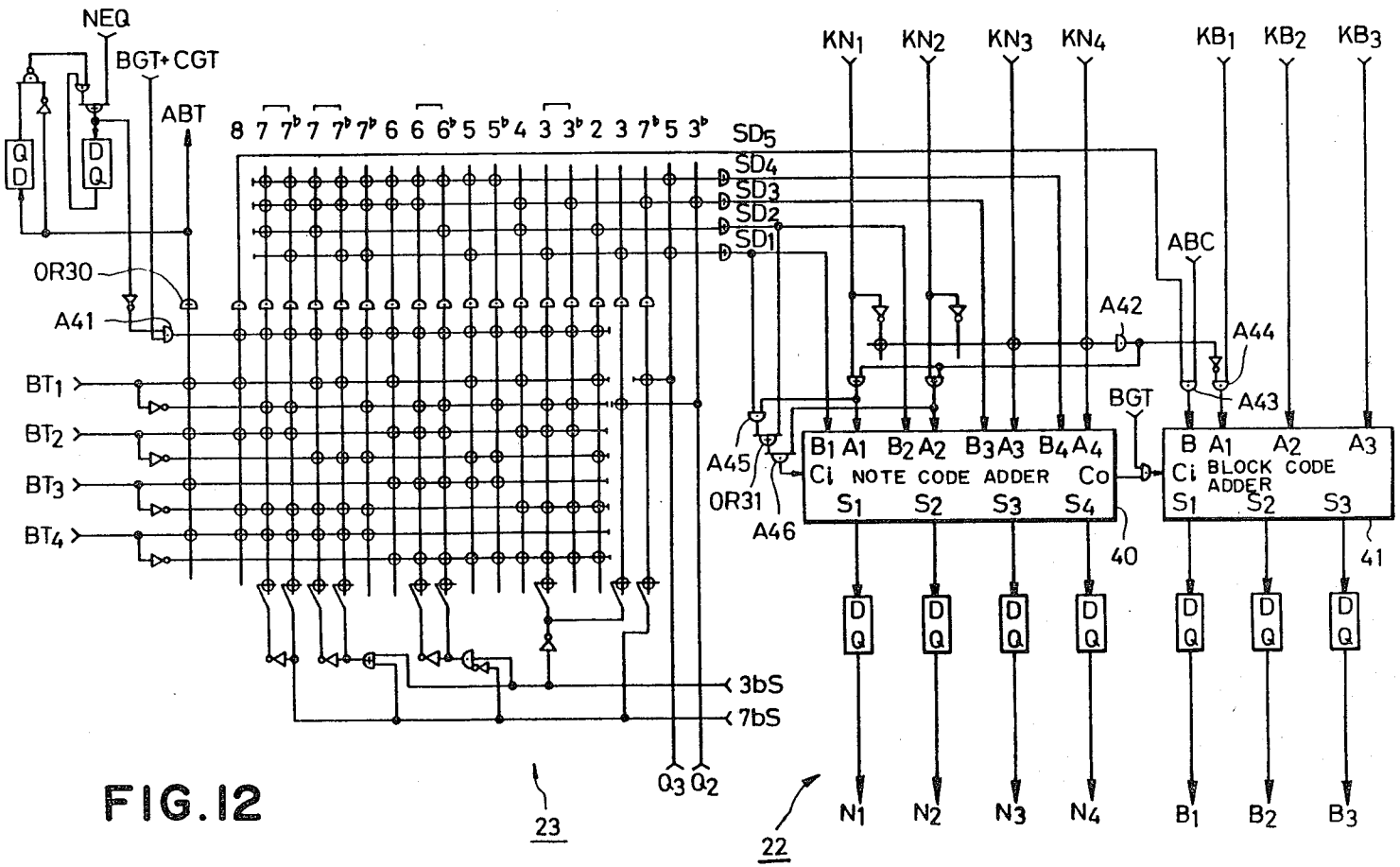
FIG. 12 is a circuit diagram showing examples of a key code processing circuit and a key code processing data generation circuit.

The block code KB1-KB3 outputted from the block code gate circuit 17 and the note code KN1-NK4 outputted from the note code gate circuit 19 are applied to a key code processing circuit 22 (FIGS. 2 and 12). This key code processing circuit 22 is provided, as will be described more fully later, for operating to form a key code for the automatic bass/chord performance when the automatic bass/chord function (the single finger function (SF), the finger chord function (FC) or the custom function (CA)) has been selected. The key code processing circuit 22 does not operate in this case but delivers the applied block code KB1-KB3 and note code KN1-KN4 as the key code KC(B1-B3, N1-N4) directly (i.e., without processing) to the channel processor 200.

The keyboard indication signals UK, LK and PK produced by the the block data gate circuit 15 coincide in the timing of delivery with the key code KC produced by the key code processing circuit 22 and a signal which constitutes one tone is formed by combination of this signal UK, LK or PK and the key code KC. In the channel processor 200 to be described later, tone assignment is conducted by using both the signal UK, LK or PK and the key code KC and no tone is assigned if either one is absent.

(4) Chord detection in the automatic bass/chord performance

A chord type in the automatic bass/chord performance is detected by the chord detection circuit 20 (FIGS. 2 and 13) by utilizing the output of the note detection circuit 13.

Figure 13:
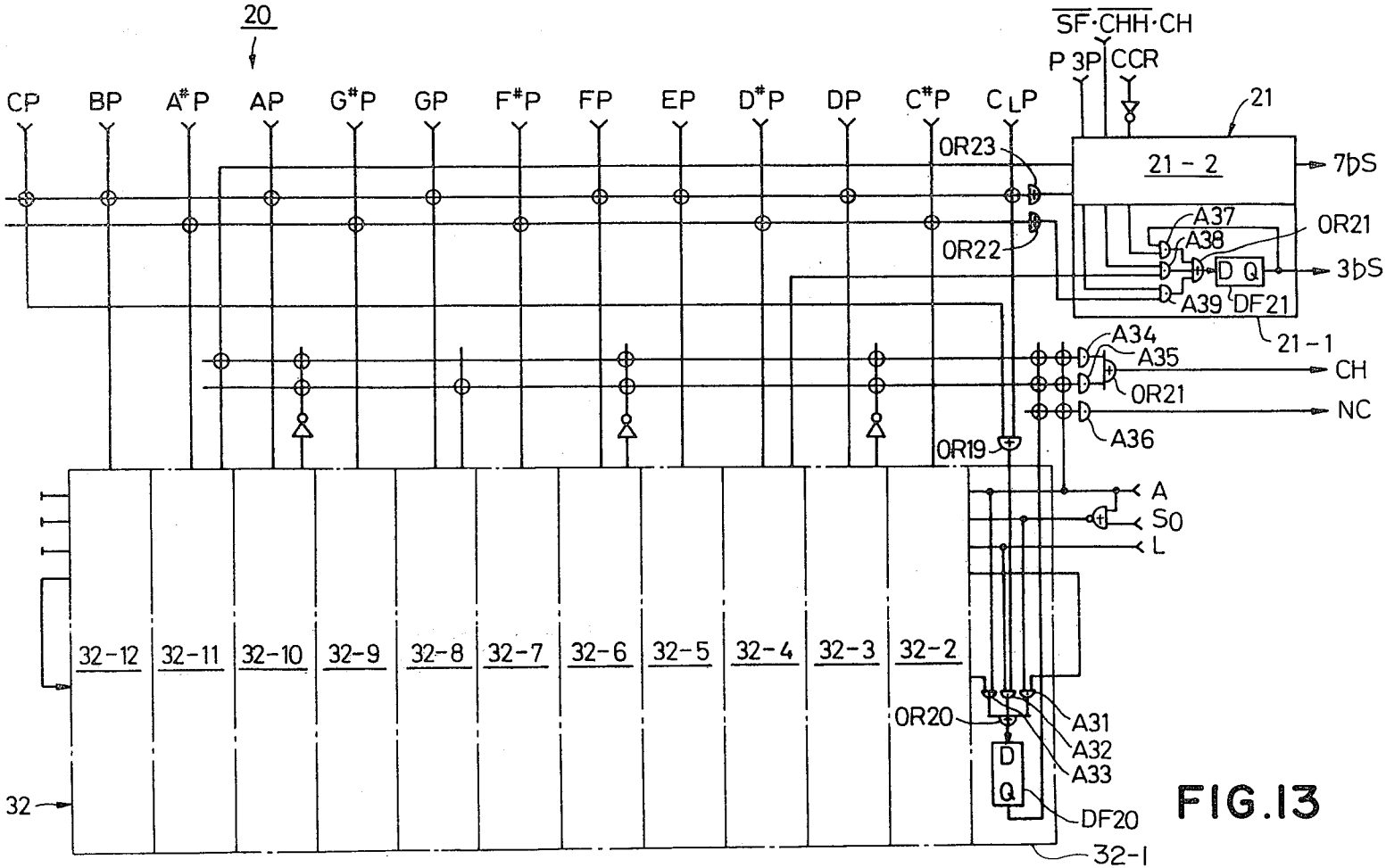
FIG. 13 is a circuit diagram showing examples of a chord detection circuit and a chord type memory.

FIG. 13 shows an example of the chord detection circuit 20.

(1) A case where the fingered-chord function (FC) or the custom function (CA) is selected.

If the fingered-chord function (FC) or the custom function (CA) is selected, the chord type is detected from the note interval relation between keys which are being depressed in the lower keyboard. The output CLP of the circuit 13-1 and the output CP of the circuit 13-13 of the note detection circuit 13 (FIG. 6) are combined through the OR gate OR19 and the outputs C#P-BP of the circuits 13-2 through 13-12 are applied to respective stages 32-1 through 32-12 of the note register 32. Each of the stages 32-1 through 32-12 of the note register 32 has an AND gate A31 for holding a signal, an AND gate A32 for loading and an AND gate A33 for shifting, as representatively shown by the stage 32-1.

Upon extraction of one of the blocks L1-L5 including the key of the lower keyboard in the block detection circuit 11 (FIG. 6) and outputting of one of the signals CLP-CP representing the note of the key being depressed in the lower keyboard from the note detection circuit 13, the AND gate A32 is enabled in response to the signal L to apply the signal (one of the signals CLP-CP) representing the key being depressed in the lower keyboard to the delay flip-flop DF20 through the AND gate A32 and OR gate OR20 of a corresponding one of the stages 32-1 through 32-12. This signal is self-held through the AND gate A3 and the OR gate OR20. Accordingly, the note register 32 loads the signal representing the note of the key being depressed in the lower keyboard in a corresponding one of the stages 32-1 through 32-12 and stores the signal therein. The signal L is a signal produced by the AND gate All (FIG. 9) of the block data gate circuit 15 (which becomes "1" in the state (S3) upon extraction of one of the blocks L1-L5 including the key of the lower keyboard in the block detection circuit 11.

In the chord detection circuit 20, the chord type is detected in the above described manner in the state (S3) subsequent to extraction of the storage of the circit 11-14 of the block detection circuit 11 (hereinafter referred to as "automatic bass/chord first processing time") and the state (S3) subsequent to extraction of the storage in the circuit 11-15 (hereinafter referred to as "automatic bass/chord second processing time") by utilizing the signal loaded in the note register 32 and representing the key depressed in the lower keyboard.

In the automatic bass/chord first processing time or the automatic bass/chord second processing time subsequent to the extraction of the storage of the circuit 11-14 or 11-15 in the block detection circuit 11, the signal holding AND gate A31 of each of the stages 32-1 through 32-12 of the note register 32 is disabled by the signal A (the output of the block data memory 14 shown in FIG. 9) and self-holding of the AND gate A31 is released. Simultaneously, the AND gate A33 for shifting is enabled and the contents stored in the respective stages 32-1 through 32-12 are respectively shifted sequentially to the lower note side (i.e. from the stage 32-12 toward the stage 32-1). In the course of this shifting, whether or not the keys being depressed in the lower keyboard constitute a predetermined type of chord is detected from relation of the storage of the stages 32-2 through 32-12 relative to the storage of the stage 32-1 (i.e., a note interval relation). This detection is performed by AND gates A34 and A35.

To the AND gate A34 are applied an output of the stage 32-1 of the note register 32, an inverted output of the stage 32-2, an output of the stage 32-6, an inverted output of the stage 32-10, an output of the stage 32-10, an output of the stage 32-11 and the signal A. To the AND gate A35 are applied an output of the stage 32-1, an inverted output of the stage 32-2, an inverted output of the stage 32-6, an output of the stage 32-8, an inverted output of the stage 32-10 and the signal A. If the tone pitches of the stages 32-2 through 32-12 are expressed on the basis of the tone pitch of the stage 32-1 of the note register 32 which is assumed to be unison, they are respectively minor second, major second, minor third, major third, perfect fourth, diminished fifth, perfect fifth, minor sixth, major sixth, minor seventh and major seventh. Accordingly, the AND gate A34 is enabled when the keys being depressed in the lower keyboard include unison and minor seventh and do not include major second, perfect fourth and major sixth. The AND gate A35 is enabled when the keys include unison and perfect fifth and do not include major second, perfect fourth and major sixth. The outputs of the AND gates A34 and A35 are combined through the OR gate OR21 and thereafter are delivered as a chord detection signal CH.

An AND gate A36 is enabled when the output of the stage 32-1 of the note register 32 is "1" while the signal A is present. In other words, if even one of the keys is depressed in the lower keyboard, the AND gate A36 is enable when the stage of the signal representing the key has been shifted to the stage 32-1 even if the key is not in the predetermined note interval relation. The output of the AND gate A36 is provided as a non-chord signal NC.

The chord type is detected on the basis of whether the output of the stage 32-4 or 32-11 of the note register 32 is present or not when the chord detection signal CH is outputted, i.e., whether the depressed keys include one for minor third or minor seventh.

If, for example, an output is provided from the stage 32-4 of the note register 32 when the chord detection signal CH is delivered, the detected chord is a minor chord. If an output is provided from the stage 32-11, the detected chord is a seventh chord. If no output is provided from the stage 32-4 or 32-11, the detected chord is a major chord. The outputs of the stages 32-4 and 32-11 of the note register 32 are respectively applied to the stages 21-1 and 21-2 of the chord type memory 21. The stages 21-1 and 21-2 comprises, as representatively shown by the stage 21-1, an AND gate A37 for holding a signal and two AND gates A38 and A39 for loading. The signals outputted from the stages 32-4 and 32-11 of the note register 32 are applied to the delay flip-flop DF21 through the AND gate A38 and the OR gate OR21 and are self-held through the AND gate A37 and the OR gate OR21. The condition for enabling the loading AND gate A38 is $\overline{SF}\cdot\overline{CHH}\cdot CH$. Ths signal CHH is an output of a chord detection signal memory 33 of the control signal generation circuit 24 (FIG. 14) to be described later. If the signal $\overline{CHH}$ is "1", it represents that the chord has not been formed yet. At the timing when the chord detection signal CH is first outputted, the AND gate A38 is enable to load the signal of the stages 32-4 and 32-11 of the note register 32. Since the single-finger function (SF) is not selected, the signal $\overline{SF}$ is "1". The signal $\overline{CHH}$ is used for detecting the chord type preferentially at the first appearance of the chord detection signal CH and not at the second and subsequent appearance thereof even though the chord detection signal CH may appear twice or more during the shifting time. The outputs of the stages 21-1 and 21-2 of the chord type memory 21 are respectively provided as a minor detection signal 3bs representing a minor chord and a seventh detection signal 7bs representing a seventh chord.

(2) A case where the single-finger (SF) is selected as the automatic bass/chord function.

In this case, the chord type is detected by utilizing the pedal keyboard. If a white (natural) key is depressed in the pedal keyboard, a seventh chord is designated whereas if a black (sharp) key is depressed in the pedal keyboard, a minor chord is designated. If neither the white (natural) key nor the black (sharp) key is depressed, a major chord is designated. The detection of depression of a white key or a black key is performed by extracting the block P1 or P2 in the block detection circuit 11 and utilizing a signal representing the note of the depressed key in the pedal keyboard which is outputted from one of the stages 13-1 through 13-13 of the note detection circuit in the subsequent stage (S3). Outputs C#P, D#P, F#P, G#P and A#P of the stages 13-2, 13-4, 13-7, 13-9 and 13-11 of the note detection circuit 13 and outputs CLP, DP, EP, GP, AP, BP and CP of the stages 13-1, 13-3, 13-5, 13-6, 13-8, 13-10, 13-12 and 13-13 are respectively combined by OR gates OR22 and OR23 and thereafter are applied to AND gates A39 of the stages 21-1 and 21-2 of the chord type memory 21. The AND gate A39 also receives a signal P.3P and, accordingly, it is enabled at the rise portion of the state (S3) which follows extraction of the block P1 or P2 in the block detection circuit 11. If, accordingly, a black key is depressed in the pedal keyboard, a signal "1" is loaded in the stage 21-1 of the chord type memory 21 and the minor detection signal 3bS representing a minor chord is outputted. If a white key is depressed, a signal "1" is loaded in the stage 21-2 of the chord type memory 21 and the seventh detection signal 7bS representing the seventh chord is delivered out. Since the single-finger function (SF) is selected, the signal $\overline{SF}$ is "0" and the AND gates A38 of the stages 21-1 and 21-2 of the chord type memory 21 are disabled.

(5) Generation of a key code for the automatic bass/chord performance

In a case where the fingered-chord function (FC), the custom function (CA) or the single-finger function (SF) is selected, a key code for the automatic bass/chord performance is formed in accordance with the depressed key during the automatic bass/chord first processing time and the automatic bass/chord processing time. The manner of forming of this key code for the automatic bass/chord performance differ depending upon the respective function (FC), (CA) and (CF) and operations are controlled by a signal from the control signal generation circuit 24 (FIG. 14).

Figure 14:
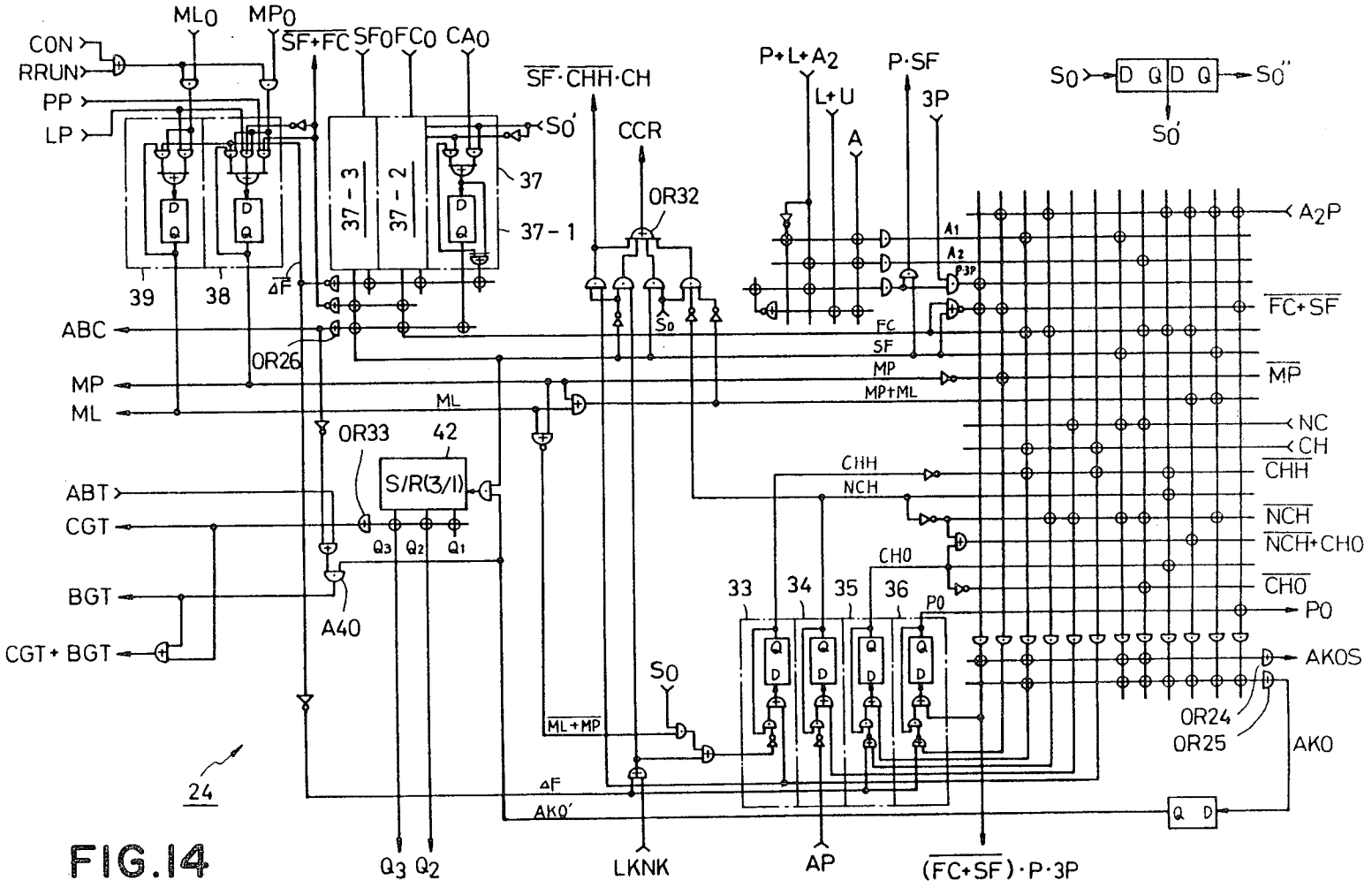
FIG. 14 is a circuit diagram showing an example of a control signal generation circuit.

FIG. 14 shows an example of the control signal generation circuit 24. The control signal generation circuit 24 forms various control signals in response to data representing function switches which are switched on in the function switch section 5 (FIG. 2). Switching on of the function switch for selecting the custom function (CA), the fingered-chord function (FC) or the single-finger function (SF) is detected by the function switch detection circuit 6 (FIG. 2) and a signal CA0, FC0, or SF0 representing the on-state of the function switch is applied to an automatic bass/chord function memory 37 of the control signal generation circuit 24. Switching on of the bass tone memory function (MP) or the chord tone memory function (ML) also is detected by the function detection circuit 6 and a signal MP0 or ML0 representing the selection of the bass tone memory function (MP) or the chord tone memory function (ML) is applied from the function detection circuit 6 to a bass tone memory signal memory 38 and a chord tone memory signal memory 39 of the control signal generation circuit 24. A load condition of the automatic bass/chord function memory 37 is formed by the signal S0 representing the state (S0) and a clear condition of the memory 37 is formed by a signal S0 which is produced by inverting the signal S0. Alternatively stated, the storage of the automatic bass/chord function memory 37 is rewritten at the timing of the signal S0 which is produced at completion of each cycle of the key switch scanning operation.

The load condition of the bass tone memory signal memory 38 is $$(CON + RRUN)\left\{\overline{(SF + F)} \cdot PP + (SF + FC)LP\right\} \quad (1)$$

The clear condition of the memory 38 is $$\Delta F + \overline{MP0} + \overline{CON + RRUN} \quad (2)$$

The signal CON represents that a constant function using the chord tone or the bass tone as a sustained tone has been selected in the function switch section 5. The signal RRUN represents that one of the rhythms is selected in the function switch section 5. The signal ΔF represents that the function switch selecting the custom function CA, the fingered-chord function (FC) or the single-finger function (SF) has been switched. The bass tone memory signal memory 38 stores the signal $MP_0$ representing that the bass tone memory function (MP) has been selected under the conditions that the constant function or one of the rhythms has been selected (CON+RRUN="1") and that the signal PP representing that the block P1 or P2 has been extracted is produced from the block detection circuit 11 (FIG. 6) (pp="1") when neither the single finger function (SF) nor the finger chord function (FC) has been selected ($\overline{SF+FC}$+"1"), i.e., when the custom function (CA) is selected whereas the signal LP representing that the block L1–L5 has been selected is produced from the block detection circuit 11 when the single-finger function (SF) or the fingered-chord function (FC) is selected (SF+FC="1"). The bass tone memory signal memory 38 clears the storage of the signal MP0 when the signal ΔF is produced (ΔF="1") or the signal MP0 is turned to "0" (MP="1") or the selection of the constant function or thythm has been released ($\overline{CON+RRUN}$="1").

The loading condition of the chord tone memory signal memory 39 is $$(CON + RRUN) \cdot LP \quad (3)$$

The clear condition of the memory 39 is $$\Delta F + \overline{ML0} + \overline{CON + RRUN} \quad (4)$$

The chord tone memory signal memory 39 stores a signal ML0 representing that a chord tone memory function is selected under the conditions that the constant function or one of the rhythms is selected (CON+RRUN="1") and that the signal LP is produced from the block detection circuit 11 (LP="1") and clears the storage of the signal ML0 when the signal ΔF is produced (ΔF="1") or the signal ML0 is turned to "0" ($\overline{ML0}$="1") or neither the constant function nor the rhythm has been selected any longer ($\overline{CON+RRUN}$="1").

The control signal generation circuit 24 comprises a chord detection signal memory 33 storing the chord detection signal CH generated by the chord detection circuit 20 (FIG. 13), a non-chord detection signal memory 34 storing the non-chord detection signal NC, a chord forming detection signal memory 35 storing a signal representing that the chord detection signal CH has been produced and a pedal tone signal memory 36 storing a signal representing that a key has been depressed in the pedal keyboard. The loading condition of the chord detection signal memory 33 is $$CH \cdot \overline{CHH} \quad (5)$$

The clear condition of the chord detection signal memory 33 is $$S0 \cdot \overline{(ML + MP)} + LKNK \ \Delta F \quad (6)$$

The loading condition of the non-chord detection signal memory 34 is $$NC \cdot \overline{NCH}$$

The clear condition of the memory 34 is $$AP(=A1P+A2P)\ldots \quad (8)$$

The loading condition of the chord forming detection signal memory 35 is $$FC \cdot CH \cdot \overline{CHH} \cdot A_1 \quad (9)$$

The clear condition of the memory 35 is $$FC \cdot \overline{NCH} \cdot A2P + \Delta F \quad (10)$$

The loading condition of the pedal tone signal memory 36 is $$\overline{(FC + SF)} \cdot P \cdot 3P \quad (11)$$

The clear condition of the memory 36 is $$(FC + SF) \cdot \overline{MP} \cdot A2P + \Delta F \quad (12)$$

The signals CHH and NCH are outputs of the chord detection signal memory 33 and the non-chord detection signal memory 34. The signals FC and SF are outputs of the stages 37-2 and 37-3 of the automatic bass/-chord function memory 37. The signal MP and ML are outputs of the bass tone memory signal memory 38 and the chord tone memory signal memory 39. The signal LKNK is produced by the assignment control circuit 26 (FIG. 16) of the channel processor 200 to be described later. The signal LKNK is a lower keyboard new key-on signal which is produced when a new key code representing a newly depressed key in the lower keyboard is applied. The signal A1 is a signal representing the automatic bass/chord first processing time.

The chord detection signal memory 33 stores the chord detection signal CH at the first timing of its appearance from the chord detection circuit 20 (FIG. 13) and clears the storage of this signal CH whenever the signal S0 is produced in case neither the bass tone memory function (MP) nor the chord tone memory function (ML) has been selected, or whenever the lower keyboard new key-on signal LKNK or the signal ΔF is produced.

The non-chord detection signal memory 34 stores the non-chord detection signal NC at the first timing of its appearance from the chord detection circuit 20 and clears the storage of the non-chord signal NC by the outputs AP1 and AP2 of the stages 11-4 and 11-5 of the block detection circuit 11.

The chord forming detection signal memory 35 stores the chord detection signal CH at the first timing of its appearance from the chord detection circuit 20 in the automatic bass/chord first processing time under the condition that the fingered-chord function (FC) is selected and clears the storage of the signal CH at the timing of the signal A2P when the signal NCH is absent (i.e., when the depressed key in the lower keyboard has been released) or at the timing of the signal ΔF).

The pedal tone signal memory 36 stores the signal P representing that a key is being depressed in the pedal keyboard at the timing of the signal 3P under the condition that neither the fingered-chord function (FC) nor the single-finger chord function (SF) is selected and clears the storage of the signal P at the timing of the signal A2P when the bass tone memory function (MP) is not selected or at the timing of the signal ΔF.

The control signal generation circuit 24 forms various control signals by employing the outputs CA, FC, SF, MP and ML of the automatic bass/chord function memory 37, the bass tone memory signal memory 38 and the chord tone memory signal memory 39 and the outputs CHH, NCH, CHO and PO of the chord detection signal memory 33, the non-chord detection signal memory 34, the chord forming detection signal memory 35 and the pedal tone signal memory 36 and performs control operations by these signals in accordance with selection by the function switches. The control operations by the control signal generation circuit 24 will now be described about the respective cases of selection by the function switches.

(1) A case where the fingered-chord function (FC) is selected

In this case, the automatic chord performance and the automatic bass performance are conducted on the basis of a plurality of keys depressed in the lower keyboard. A plurality of key codes representing the keys depressed in the lower keyboard are supplied to the channel processor 200 as key codes representing the chord tone and the key codes representing the bass tone are formed in accordance with the chord type constituted of the plurality of keys depressed in the lower keyboard using one of the keys depressed in the lower keyboard as the root note.

The root note for the automatic bass performance in the fingered-chord function (FC) is formed by using the signals representing notes CL-C which are sequentially delivered from the note detection circuit 13 during the automatic bass/chord first processing time or the automatic bass/chord second processing time. The signals sequentially delivered from the note detection circuit 13 during the automatic bass/chord first processing time or the automatic bass/chord second processing time coincide completely with the timing of shifting of the note register 32 of the chord detection circuit 20 (FIG. 13) and the signals delivered form the note detection circuit 13 corresponding to notes shifted to the stages 32-1 of the note register 32. Accordingly, the signal KN1P–KN4P delivered from the note detection circuit 13 at the time when forming of the chord has been detected in the chord detection circuit 20 (i.e., when the chord detection signal CH has been generated) is loaded in the note code memory 18 (FIG. 11) as the note code KN1–KN4 representing the note of a root note.

This loading of the note of the root note in the note code memory 18 is conducted by the signal AKOS. This signal AKOS is delivered from the OR gate OR24 of the control signal generation circuit 24 and is expressed by the following logical formula:

$$\begin{aligned} AKOS = {} & FC \cdot \overline{CHH} \cdot CH \cdot A1 \\ & + FC \cdot \overline{CHO} \cdot \overline{NCH} \cdot NC \cdot A2 \\ & + SF \cdot \overline{NCH} \cdot NC \cdot A1 \\ & + \overline{(FC + SF)} \cdot P \cdot 3P \end{aligned} \quad (13)$$

The signal A1 represents the automatic bass/chord first processing time and the signal A2 the automatic bass/chord second processing time.

If the fingered-chord function (FC) is selected, the first and second terms only of the logical formula (13) paticipate in formation of the signal AKOS. More specifically, the signal AKOS becomes "1" at the timing of first appearance ($\overline{CHH}$="1") of the chord detection signal CH from the chord detection circuit 20 in the automatic bass/chord first processing time (A1="1"). This causes the AND gate A27 of the note code memory 18 (FIG. 11) to be enabled and the signal KNlP outputted from the note detection circuit 13 at this timing is loaded in the delay flip-flop DF18 as the note code KN1–KN4 representing the root note.

If the chord detection signal CH is not delivered from the chord detection circuit 20 in the automatic bass/chord first processing time (A1="1"), the root note is detected by the non-chord signal NC outputted from the chord detection circuit 20 in the next automatic base/chord second processing time (A2="1"). If the chord detection signal CH is not produced in the automatic bass/chord first processing time, the output CHO of the chord forming detection signal memory 35 (FIG. 14) is "0". Accordingly, the condition of the second term of the logical formula (13) are satisfied at the time point when the first non-chord signal NC is produced in the automatic bass/chord second processing time, and the signal KN1P–KN4P delivered from the note detection circuit 13 at this time is loaded in the delay flip-flop DF18 of the chord memory 18 as the note code KN1–KN4 representing the root note.

The note code KN1–KN4 representing the root note which is loaded in the delay flip-flop DF18 of the note code memory 18 is delivered through the AND gate A30 which is enabled by a bass tone gate timing signal BGT and the OR gate OR18 of the note code gate circuit 19. The bass tone gate timing signal BGT is delivered from an AND gate A40 (FIG. 14) of the control signal generating circuit 24 and is expressed by the following logical formula (14):

$$BGT = AKO' \, (ABT + \overline{ABC}) \tag{14}$$

The signal AKO' is a signal obtained by delaying the signal AKO outputted by the OR gate OR25 (FIG. 14) of the control signal generation circuit 24 by 1 bit time (54 microseconds). This signal AKO is expressed by the following logical formula (15):

$$\begin{aligned} AKO = {} & FC \cdot \overline{CHH} \cdot CH \cdot A1 \\ & + FC \cdot \overline{CHH} \cdot \overline{NCH} \cdot NC \cdot A2 \\ & + FC \cdot CHO \cdot NCH \cdot \overline{CHH} \cdot A2P \\ & + FC \cdot (CHO + \overline{NCH}) \, (ML + MP) \cdot A2P \\ & + SF \cdot \overline{NCH} \cdot NC \cdot A1 \\ & + SF \cdot \overline{NCH} \cdot (ML + MP) \cdot A2P \\ & + (\overline{FC + SF}) \cdot PO \cdot A2P \end{aligned} \tag{15}$$

The signal ABT is a bass tone timing signal outputted from the OR gate OR30 (FIG. 12) of the key code processing data generation circuit 23 to be described later and representing that the bass pattern BT1–BT4 is being generated from the pattern generator 4(FIG. 2). The signal $\overline{ABC}$ is a signal produced by inverting the output of the OR gate OR26 of the control signal generation circuit 24 and becomes "1" when none of the fingered-chord function (FC), the single-finger function (SF) and the custom function (CA) is selected.

Accordingly, if the fingered-chord function (FC) is selected, the first through fourth terms of the formula (15) participate in the formation of the signal AKO. The first and second terms of the formula (15) are the same as those of the above described formula (13). More specifically, the logical condition of the first term of the formula (15) is satisfied at the timing of first appearances of the chord detection signal CH in the automatic bass/chord first processing time and upon lapse of 1 bit time (54 microseconds) thereafter the signal BGT is turned to "1" to enable the AND gate A30 of the note code gate circuit 19, and the note code KN1–KN4 representing the note of the root tone and loaded in the note code memory 18 at the timing when the logical condition of the first term of the formula (13) is satisfied is outputted through the OR gate OR18.

If the non-chord detection signal NC is produced in the automatic bass/chord second processing time on the condition that the chord detection signal CH has not been produced in the automatic bass/chord first processing time, the logical condition of the second term of the formula (15) is satisfied and upon lapse of 1 bit time (from this timing) the note code KN1–KN4 representing the note of the root tone and loaded in the note code memory 18 at the timing when the logical condition of the second term of the formula (13) is satisfied is outputted through the note code gate circuit 19.

The third term of the formula (15) is of significance in a case where a chord has once been formed by a plurality of keys depressed in the lower keyboard but the chord has ceased to exist for a part of the keys has been released or a part of the depressed keys has been changed. If the chord detection signal CH is produced in the automatic bass/chord first processing time and a signal "1" is stored in the chord forming detection signal memory 35(FIG. 14) and thereafter the chord ceases to exist for a part of the keys has been released or a part of the depressed keys has been changed, the condition of the first term of the formula (15) is not satisfied in the automatic bass chord first processing time of a next cycle and the condition of the second term of the formula (15) is not satisfied in the subsequent automatic bass/chord second processing time for the signal CHO has not been cleared. Accordingly, if there are only the first and second terms in the formula (15), outputting of the note code (KN1–KN4) representing the note of the root tone from the note code gate circuit 19 (FIG. 11) is stopped and the key code for the automatic bass performance cannot be formed any longer. The third term of the formula (15) is satisfied at the timing of the signal A2P if the chord has once been formed by a plurality of keys depressed in the lower keyboard and thereafter the chord has ceased to exist for a part of the keys has been released or a part of the depressed keys has been changed. Accordingly, the bass tone gate timing signal BGT becomes "1" at the first timing of the automatic bass/chord second processing time which is 1 bit time (54 microseconds) after the timing of the signal A2P and the signal representing the root note loaded in the note code memory 18 before release or change of a part of the depressed keys is outputted through the note code gate circuit 19. In other words, if the chord has once been formed by the keys depressed in the lower keyboard and then ceases to exist, the root note detected before release or change of a part of the depressed keys continues to be used.

The fourth term of the formula (15) is for a case where the chord tone memory function (ML) or the bass tone memory function (MP) to be described more fully later has been selected and detailed description thereof is omitted here.

When the note code KN1–KN4 representing the note of the root tone is delivered from the note code gate circuit 19(FIG. 11), the block code KB3–KB1 representing the octave of the root note is outputted from the block code gate circuit 17 (FIG. 10) and the pedal keyboard signal PK representing the pedal keyboard tone (bass tone) is delivered from the block data gate circuit (FIG. 9) in synchronism with the timing of the note code KN1–KN4. In FIG. 10, if the fingered-chord function (FC) is selected, the AND gate A25 to which a signal (SF+FC) produced by inverting the signal $\overline{SF+FC}$ is applied is enabled. Accordingly, the AND gate A25 outputs a signal "1" at the bass tone gate timing signal BGT. This signal "1" is applied to the OR gate OR15 thereby to turn the signal KB1 to "1". Accordingly, the block code KB3–KB1 "001" representing the first octave is delivered at the timing of the bass tone gate timing signal BGT. In FIG. 9, if the finger chord function (FL) is selected, the AND gate A15 of the block data gate circuit 15 is enabled to apply the output of the AND gate A11 representing the depressed key in the lower keyboard to the delay flip-flop DF13 through the OR gate OR11 to be self-held in the delay flip-flop DF13 through the AND gate A16 and the OR gate OR11. This self-held signal is delivered as the pedal keyboard signal PK representing the pedal keyboard tone through an AND gate A20 enabled at the timing of the bass tone gate timing signal BGT and an OR gate OR14. Accordingly, the pedal keyboard signal PK is outputted from the block data gate circuit 15 at the timing of the bass tone gate timing signal BGT. The AND gate A16 is disabled by a signal SO" which is produced by delaying the signal representing the state (SO) by 2 bit time (96 microseconds) so that the storage in the delay flip-flop DF13 is cleared at the timing of this signal SO". This signal SO" is produced by the control signal generation circuit 24 (FIG. 14).

The block code KB1–KB3 outputted from the block code gate circuit 17 representing the octave of the root note and the note code KN1–KN4 outputted from the note code gate circuit 19 representing the root note are applied to a key code processing circuit 22 and are formed into a key code representing the bass tone by processing them by key code processing data SD1–SD5 generated by a key code processing data generation circuit 23.

FIG. 12 shows examples of the key code processing circuit 22 and the key code processing data generation circuit 23. The key code processing circuit 22 and the key code processing data generation circuit 23 are basically the same as the key code processing circuit and the subordinate tone forming data generation circuit disclosed in the specification of the Japanese Patent Application No. 1978–4975 (Laid-open No. 1979–98231) entitled "Electronic musical instrument" so that detailed description of these circuits is omitted and they are only schematically described. The key code processing circuit 22 comprises a 4-bit note code adder 40 in which the note code KN1–KN4 outputted from the note code gate circuit 19 is applied to A inputs A1–A4 and a 3-bit block code adder 41 in which the block code KB1–KB3 outputted from the block code gate circuit 17 is applied to A inputs A1–A3.

The key code processing data generation circuit 23 generates predetermined key code processing data SD1–SD5 in response to the bass pattern BT1–BT4 generated by the pattern generator 4 (FIG. 2) and signals representing the chord type and stored in the chord type memory 21(FIG. 13) (i.e., minor detection signal 3bS and seventh detection signal 7bS). Relations between the key code processing data SD1–SD5 generated by the key code processing data generation circuit 23 and the bass pattern BT1–BT4 in cases where neither the minor detection signal 3bS nor the seventh detection signal 7bS is stored in the chord type memory 21, i.e., the major chord has been designated, where the minor detection signal 3bS only is stored in the chord type memory 21, i.e., the minor chord has been designated and where the seventh detection signal 7bS only is stored in the chord type memory 21, i.e., the seventh chord has been designated, are shown in the following Tables 4, 5 and 6.

TABLE 4

| In case of a major chord | | | | | | | | |
|---|---|---|---|---|---|---|---|---|
| BT4 | BT3 | BT2 | BT1 | SD5 | SD4 | SD3 | SD2 | SD1 |
| 0 | 0 | 0 | 0 | | 0 | 0 | 0 | 0 |
| 0 | 0 | 0 | 1 | | 0 | 0 | 1 | 0 |
| 0 | 0 | 1 | 0 | | 0 | 1 | 0 | 1 |
| 0 | 0 | 1 | 1 | | 0 | 1 | 1 | 0 |
| 0 | 1 | 0 | 0 | | 1 | 0 | 0 | 0 |
| 1 | 0 | 0 | 1 | | 1 | 0 | 0 | 1 |
| 0 | 1 | 1 | 0 | | 1 | 1 | 0 | 0 |
| 0 | 1 | 1 | 1 | | 1 | 1 | 0 | 0 |
| 1 | 0 | 0 | 0 | | 1 | 1 | 0 | 1 |
| 1 | 0 | 0 | 1 | | 1 | 1 | 1 | 0 |
| 1 | 0 | 1 | 0 | | 1 | 1 | 1 | 0 |
| 1 | 0 | 1 | 1 | 1 | 0 | 0 | 0 | 0 |

TABLE 5

| In case of a minor chord | | | | | | | | |
|---|---|---|---|---|---|---|---|---|
| BT4 | BT3 | BT2 | BT1 | SD5 | SD4 | SD3 | SD2 | SD1 |
| 0 | 0 | 0 | 0 | | 0 | 0 | 0 | 0 |
| 0 | 0 | 0 | 1 | | 0 | 0 | 1 | 0 |
| 0 | 0 | 1 | 0 | | 0 | 1 | 0 | 0 |
| 0 | 0 | 1 | 1 | | 0 | 1 | 1 | 0 |
| 0 | 1 | 0 | 0 | | 1 | 0 | 0 | 0 |
| 0 | 1 | 0 | 1 | | 1 | 0 | 0 | 1 |
| 0 | 1 | 1 | 0 | | 1 | 0 | 1 | 0 |
| 0 | 1 | 1 | 1 | | 1 | 1 | 0 | 0 |
| 1 | 0 | 0 | 0 | | 1 | 1 | 0 | 1 |
| 1 | 0 | 0 | 1 | | 1 | 1 | 0 | 1 |
| 1 | 0 | 1 | 0 | | 1 | 1 | 1 | 0 |
| 1 | 0 | 1 | 1 | 1 | 0 | 0 | 0 | 0 |

TABLE 6

| In case of a seventh chord | | | | | | | | |
|---|---|---|---|---|---|---|---|---|
| BT4 | BT3 | BT2 | BT1 | SD5 | SD4 | SD3 | SD2 | SD1 |
| 0 | 0 | 0 | 0 | | 0 | 0 | 0 | 0 |
| 0 | 0 | 0 | 1 | | 0 | 0 | 1 | 0 |
| 0 | 0 | 1 | 0 | | 0 | 1 | 0 | 0 |
| 0 | 0 | 1 | 1 | | 0 | 1 | 1 | 0 |
| 0 | 1 | 0 | 0 | | 1 | 0 | 0 | 0 |
| 0 | 1 | 0 | 1 | | 1 | 0 | 0 | 1 |
| 0 | 1 | 1 | 0 | | 1 | 1 | 0 | 0 |
| 0 | 1 | 1 | 1 | | 1 | 1 | 0 | 0 |
| 1 | 0 | 0 | 0 | | 1 | 1 | 0 | 1 |

TABLE 6-continued

| In case of a seventh chord | | | | | | | | |
|---|---|---|---|---|---|---|---|---|
| BT4 | BT3 | BT2 | BT1 | SD5 | SD4 | SD3 | SD2 | SD1 |
| 1 | 0 | 0 | 1 | | 1 | 1 | 0 | 1 |
| 1 | 0 | 1 | 0 | | 1 | 1 | 0 | 1 |
| 1 | 0 | 1 | 1 | 1 | 0 | 0 | 0 | 0 |

If the key depressed in the lower keyboard is changed from one key to another and the note code KN1–KN4 representing the root tone stored in the delay flip-flop DF18 (FIG. 11) of the note code memory 18 thereby is changed, a new root tone signal NEQ is produced from the OR gate OR9 and an AND A41 (FIG. 12) of the key code processing data generation circuit 23 is disabled by the this new root tone signal NEQ and generation of the key code processing data SD1–SD5 is temporarily suspended until the fall of the bass timing signal ABT.

The key code processing data SD1–SD4 generated from the key code processing data generation circuit 23 is applied to B inputs B1–B4 of the note code adder 40 of the key code processing circuit 22 whereas the data SD5 is applied to a B input B1 of the block code adder 41 through an AND gate A43 which is enabled by the signal ABC which represents that the automatic bass/-chord function has been selected. The note code adder 40 and the block code adder 41 from key codes representing subordinate notes having a certain note interval relation relative to the root note by adding, the key code processing data SD1–SD5 to the note code KN1–KN4 representing the root note and the block code KB1–KB3 representing the octave of the root note. This forming of the subordinate notes is effected by utilizing the fact that the note code KN1–KN4 assumes a circulating value. As shown in Table 3, "0100" is ommited between the note code "0011" representing the note D# and the note code "0101" representing the note E, "1000" is omitted between the note code "0111" representing the note F# and the note code "1001" representing the note G, "1100" is omitted between the note code "1011" representing the note A and the note code "1101" representing the note A# "0000" is omitted between the note code "1111" representing the note C and the note code "0001" representing the note C#. For the note CL on the lower note side, "1100" which is one of the omitted codes is specially used. An AND gate A42 is provided for converting the note code "1111" representing the note C on the higher note side. The output of the AND gate A42 is applied to an AND gate A44 through an inverter. In case the note code "1100" representing the note CL is to be converted to "1111", the AND gate A44 is disabled to change the block code KB3–KB1 applied to the block code adder 41 to "000" and thereby to lower the octave by one octave. A circuit formed by an AND gate A45, or OR gate OR31 and an AND gate A46 is a numerical value correction circuit for preventing the result of addition in the note code adder 40 from amounting to the unused note codes "0100", "1000" "1100" and "0000".

The key code KC (N1–N4, B1–B3) outputted from the key code processing circuit 22 is supplied to the channel processor 200 as a key code corresponding to the bass tone.

(2) A case where the finger chord function (FC) and the bass tone memory function (MP) are selected and the key depressed in the lower keyboard is released.

In this case, the key code representing the bass tone is generated in accordance with the root note and chord type produced before release of the key and the automatic bass performance thereby is conducted. Since, however, the key-on signal for the chord tone (i.e. the lower keyboard tone) stored in the key-on memory 42 of the channel processor 200 to be described later is cleared by the release of the key in the lower keyboard, the chord tone is no longer played automatically.

If the note code KN1–KN4 representing the root note is loaded in the delay flip-flop DF18 of the note code memory 18 (FIG. 11) under the condition of the first or second term of the formula (13) and the key depressed in the lower keyboard thereafter is released, the chord detection signal CH or the non-chord detection signal NC is not produced in the next automatic bass/chord first processing time. Under the condition that the bass tone memory function (MP) is selected, the logical condition of the fourth term of the formula (15) is satisfied at the timing of the signal A2P and the bass tone gate timing signal BGT becomes "1" at the first timing of the automatic bass chord second processing time. Responsive to this signal BGT, the note code KN1–KN4 representing the note of the root note and stored in the delay flip-flop DF18 of the note code memory 18 before release of the key is delivered through the note code gate circuit 19.

At this time, the block code KB3–KB1 "001" representing the first octave is delivered from the block code gate circuit 17 (FIG. 10). In the block data gate circuit 15 (FIG. 9), the signal "1" stored in the delay flip-flop DF13 is held by the AND gate A17 which is enabled by the bass tone memory signal MP and, accordingly, this signal "1" is outputted as the pedal kayboard signal PK representing the pedal keyboard tone (i.e. bass tone) through the AND gate A20 and the OR gate OR14 at the timing of the bass tone gate timing signal BGT even after release of the key in the lower keyboard.

The note code KN1–KN4, representing the root note and the block code KB1–KB3 representing the octave of the root note respectively delivered from the note code gate circuit 19 and the block code gate circuit 17 are applied to the key code processing circuit 22 (FIG. 12) where these codes are processed for forming the key code representing the bass tone.

In the logical conditions of the fourth term of the formula (15), there is one based on the signal CHO besides one based on the signal $\overline{NCH}$. This arrangement is made for coping with a case where a some of the depressed keys in the lower keyboard have been released and the rest of the keys have not been released yet. Even though the player may have intended to release all of the keys depressed in the lower keyboard simultaneously, some of them may actually remain depressed. In this case, the non-chord signal NC is generated with a result that the signal NCH is produced. Accordingly, the arrangement is made to generate the bass tone gate timing signal BGT by utilizing the signal CHO.

The chord type memory 21 (FIG. 13) which stores the chord type detected on the basis of the keys depressed in the lower keyboard is not cleared even after release of the keys when the bass tone memory function (MP) is selected. The contents stored in the chord type memory 21 are cleared by the signal CCR and this signal CCR is formed by the OR gate OR32 of the control signal generation circuit 24 (FIG. 14). This signal CCR is expressed by the following logical formula (16).

$$CCR = \overline{SF} \cdot \overline{CHH} \cdot CH + \overline{SF}(\Delta F + LKNK) + SF \cdot S0 + S0 \cdot \overline{NCH} \cdot \overline{(ML + MP)} \quad (16)$$

As will be apparent from the logical conditions of the fourth term of the formula (16), if the bass tone memory function (MP) is not selected, the storage of the chord type memory 21 is cleared at the timing of the signal S0 when the key depressed in the lower keyboard is released (NCH=0). If, however, the bass tone memory function (MP) is selected, the conditions of the forth term of the formula (16) are not satisfied even if the key depressed in the lower keyboard is released so that the storage of the chord type memory 21 is not cleared. Accordingly, the key code processing data SD1–SD5 is generated from the key code processing data generation circuit 23 (FIG. 12) even after release of the keys in accordance with the chord type formed by the keys which were depressed in the lower keyboard.

(3) A case where the fingered-chord function (FC) and the chord tone memory function (ML) are selected and the keys depressed in the lower keyboard are released.

In this case, tones of the keys which were depressed in the lower keyboard are automatically played as chord tones even after release of the keys. The pedal keyboard signal PK representing the bass tone ceases to be supplied to the channel processor 200 upon release of the keys so that the automatic bass performance is prohibited.

Continuation of the automatic chord performance after release of the keys is effected by not clearing the key-on signal for the chord tones (i.e. the lower keyboard tones) stored in the key-on memory 42 on the condition that the chord tone memory signal ML is "1" in the channel processor 200.

In the case where the chord tone memory function (ML) is selected, the key code corresponding to the bass tone is formed in the key code processing circuit 22 in a manner similar to the case where the bass tone memory function (MP) is selected. Since, however, a signal "1" is no longer supplied to the delay flip-flop DF13 of the block data gate circuit 15 (FIG. 9) by release of the keys depressed in the lower keyboard, the pedal keyboard signal PK representing the bass tone is not supplied to the channel processor 200 even if the AND gate A20 is enabled by the bass tone gate timing signal BGT. The channel processor 200 does not assign the key code corresponding to the bass tone supplied from the key code processing circuit 22 unless it receives the pedal keyboard signal PK. Accordingly, the automatic bass performance thereby is prohibited.

(4) A case where the single-finger function (SF) is selected

In this case, the automatic chord performance and the automatic bass performance are conducted on the basis of the tone of a single key depressed in the keyboard. More specifically, key codes constituting chord tones are formed in accordance with the tone of the single key depressed in the lower keyboard and key codes representing the bass tones are formed on the basis of the tone of the single key which is used as the root note. Generation of key codes representing the chord tones and key codes representing the bass tones in a case where the single-finger function (SF) is selected is effected during the automatic bass/chord first processing time.

At the timing of the first appearance of the non-chord detection signal NC from the chord detection circuit 20 (FIG. 13) in the automatic bass/chord first processing time, the conditions of the third term of the formula (13) are satisfied and the AND gate A28 of the note code memory 18 (FIG. 11) is enabled and the note code KN1–KN4 outputted at this time from the note detection circuit 13 is loaded in the delay flip-flop DF18 as a note code of the root tone for the automatic chord performance and the automatic bass performance. The timing at which the non-chord detection signal NC is generated from the chord detection circuit 20 (FIG. 13) coincides with the timing at which the signal representing the key depressed in the lower keyboard is shifted to the stage 32-1 in the note register 32 and the note code KN1–KN4 representing this key is delivered from the note detection circuit 13. Accordingly, this note code KN1–KN4 loaded in the note code memory 18 represents the tone of the key depressed in the lower keyboard (in case a plurality of keys are being depressed, the lowest tone).

On the basis of the note code KN1–KN4 representing the root note loaded in the delay flip-flop DF18 of the note code memory 18, the key codes representing the bass tones and the key codes representing the chord tones are subsequently produced. The manner of generation of the key codes representing the bass tones to be described below is substantially the same as in the case where the finger chord function (FC) has been selected.

The logical conditions of the third term of the formula (13) and those of the fifth term of the formula (15) are simultaneously satisfied. Upon lapse of 1 bit time (54 microseconds) thereafter, the bass tone gate timing signal BGT becomes "1" and the note code KN1–KN4 stored in the delay flip-flop DF18 of the note code memory 18 is read from the note code gate circuit 19 (FIG. 11) at the timing of the bass tone gate timing signal BGT. At this time (i.e., at the timing of the signal BGT), the block data KB3–KB1 "001" representing the first octave is outputted from the block code gate circuit 17 (FIG. 10) and the signal which has been held in the delay flip-flop DF13 is outputted from the block data gate circuit 15 (FIG. 9) as the pedal keyboard signal PK representing the bass tone.

The note code KN1–KN4 outputted from the note code gate circuit 19 (FIG. 11) and the block code KB1–KB3 outputted from the block code gate circuit 17 (FIG. 10) are applied to the key code processing circuit 22 (FIG. 12) where they are processed into the key code representing the bass tone by the key code processing data SD1–SD5 formed in the key code processing data generation circuit 23 (FIG. 12) in accordance with the output of the chord type memory 21 (FIG. 13) and the bass pattern BT1–BT4 generated from the pattern generator 4 (FIG. 2). An only difference from the case where the finger chord function (FC) has been selected resides in that the contents of the chord type memory 21 are designated by the pedal keyboard (depression of a white key or a black key).

The key codes representing the chord tones are formed on the basis of the note code KN1–KN4 stored in the delay flip-flop DF18 of the note-code memory 18 and read from the note code gate circuit 19 (FIG. 11) in response to the chord tone gate timing signal CGT. The chord tone gate timing signal CGT is generated from an OR gate OR33 of the control signal generation circuit 24 (FIG. 14) and stays in "1" during 3 bit time (54 microseconds×3) from a time point which is 1 bit time (54 microseconds) after the gate timing signal BGT under the condition that the single-finger function (SF) is selected. To this OR gate OR33 are applied outputs Q1–Q3 of respective stages of a 3-stage shift register 42 which in turn receives the signal SF·AKO'. The chord tone gate timing signal CGT is applied to the AND gate A30 of the note code gate circuit 19 (FIG. 11) to enable the AND gate A30. This causes the note code KN1–KN4 stored in the delay flip-flop DF18 of the note code memory 18 to be read from the note code gate circuit 19. The chord tone gate timing signal BGT is applied to the OR gate OR16 of the block code gate circuit 17 (FIG. 10) to turn the block code KB1–KB3 delivered from the block code gate circuit 17 to "010" representing the second octave. The chord tone gate timing signal CGT is applied to the AND gate A19 of the block date gate circuit 15 (FIG. 9) to enable the AND gate A19. To the other input of the AND gate A19 is applied an output of the delay flip-flop DF11 which has held a signal "1" outputted from the AND gate A11 and representing that a key has been depressed in the lower keyboard through the AND gate A12 and the OR gate OR10. Accordingly, the output "1" of the delay flip-flop DF11 is applied to the OR gate OR13 through the AND gate A19 while the chord tone gate timing signal CGT is being produced so that the lower keyboard signal LK representing the lower keyboard tone (chord tone) is outputted from the OR gate OR13.

The note code KN1–KN4 and the block code KB1–KB3 outputted from the note code gate circuit 19 (FIG. 11) and the block code gate circuit 17 (FIG. 2) at the timing of the chord tone gate timing signal CGT are applied to the key code processing circuit 22 (FIG. 12) and the key codes corresponding to the chord tones are formed by the key code processing data SD1–SD4 generated from the key code processing data generation circuit 23 (FIG. 12). The key code processing data SD1–SD4 for forming the chord tones in case the single finger function (SF) has been selected is sequentially generated in accordance with the outputs Q2, Q3 of the shift register 42 of the control signal generation circuit 24 (FIG. 14) and contents of the chord type memory 21. Relation between the key code processing data SD1–SD4 for forming the chord tones sequentially generated from the key code processing data generation circuit 23 (FIG. 12) and the output Q1–Q3 of the shift register 42 is shown in the following Tables 7–9:

TABLE 7

| | A case where the major chord is designated | | | |
|---|---|---|---|---|
| | SD4 | SD3 | SD2 | SD1 |
| Q1 | 0 | 0 | 0 | 0 |
| Q2 | 0 | 1 | 0 | 1 |
| Q3 | 1 | 0 | 0 | 1 |

TABLE 8

| | A case where the minor chord is designated | | | |
|---|---|---|---|---|
| | SD4 | SD3 | SD2 | SD1 |
| Q1 | 0 | 0 | 0 | 0 |
| Q2 | 0 | 1 | 0 | 0 |
| Q3 | 1 | 0 | 0 | 1 |

TABLE 9

| | A case where the seventh chord is designated | | | |
|---|---|---|---|---|
| | SD4 | SD3 | SD2 | SD1 |
| Q1 | 0 | 0 | 0 | 0 |
| Q2 | 0 | 1 | 0 | 1 |
| Q3 | 1 | 1 | 0 | 1 |

(5) A case where the single-finger function (SF) and the base tone memory function (MP) are selected and the key depressed in the lower keyboard is released.

In this case, key codes representing the bass tones are formed after the release of the key with the tone of the single key which has been depressed in the lower keyboard being used as the root note and the automatic bass thereby is performed. Since, however, the lower keyboard signal L representing the chord tones is no longer generated from the block data gate circuit 15 (FIG. 9) at the timing of generation of the key codes representing the chord tones, the automatic chord performance is prohibited.

If the key depressed in the lower keyboard is released after the note code KN1–KN4 representing the note of the root note is loaded in the delay flip-flop DF18 of the note code memory 18 (FIG. 11) in accordance with the conditions of the third term of the formula (13), the non-chord signal NC is not produced in a next automatic bass/chord first processing time. Since, however, the bass tone memory function (MP) is selected, the conditions of the sixth term of the formula (15) are satisfied at the timing of the signal A2P and the bass tone gate timing signal BGT is turned to "1" at the first timing of the automatic bass/chord second processing time. The note code KN1–KN4 representing the root note stored in the delay flip-flop DF18 of the note code memory 18 is delivered in response to this signal BGT through the note code gate circuit 19 (FIG. 11).

At this time (i.e., at the timing of the bass tone gate timing signal BGT), the block code KB3–KB1 "001" representing the first octave is delivered from the block code gate circuit 17 (FIG. 10) and the pedal keyboard signal PK representing the bass tone is outputted from the block data gate circuit 15 (FIG. 9). The operations of the block code gate circuit 17 and the block data gate circuit 15 in this case are the same as in the case where the fingered-chord function (FC) and the bass tone memory (MP) are selected.

Accordingly, the channel processor 200 assigns the key code corresponding to the bass tone formed in the key code processing circuit 22 to a corresponding tone production channel in accordance with the outputs of the note code gate circuit 19 and the block code gate circuit 17 whereby the automatic bass performance is continued.

At a timing at which the chord tone gate timing signal CGT is "1", the note code KN1–KN4 representing the note of the root note stored in the note code memory 18 is read from the note code gate circuit 19 (FIG. 11) and the block code "010" is read from the block code gate circuit 17 (FIG. 10) similarly to the timing of the bass tone gate timing signal BGT, whereby the key codes corresponding to the chord tones are sequentially formed in the key code processing circuit 22 (FIG. 12). If, however, the key depressed in the lower keyboard is released, the storage of the delay flip-flop DF11 of the block data gate circuit 15 (FIG. 9) remains cleared after the timing of the signal So" and the signal "1" is not loaded again so that the lower keyboard signal LK is not delivered at the chord tone gate timing signal CGT. Accordingly, the channel processor 200 does not assign the key codes of the chord tones generated from the key code processing circuit 22 to its channels (i.e., the storage of the key-on memory 42 is cleared) and the automatic chord performance is thereby prohibited.

If the single-finger function (SF) is selected, the chord type is designated by the pedal keyboard. The storage of the chord type memory 21 storing the chord type designated by the pedal keyboard is cleared upon satisfaction of the condition of the third term of the formula (16), i.e., by the signal S0 representing the state (S0) which is produced upon completion of each cycle of scanning of the key switches. Accordingly, if the key depressed in the pedal keyboard during the automatic performance by the bass tone memory function (MP) is changed, the chord type can thereby be changed and the bass tone can be changed. It should be noted that the root tone does not change.

(6) A case where the single-finger function (SF) and the chord tone memory function (ML) are selected and the key depressed in the lower keyboard is released.

In this case, key codes representing the chord tones are produced even after release of the key with the tone of the single key which has been depressed in the lower keyboard being used as the root note and the automatic chord performance thereby is conducted. Since, however, the pedal keyboard signal PK representing the bass tone is no longer generated from the block data gate circuit 15 (FIG. 5), the automatic bass performance is prohibited.

In case the single-finger function (SF) and the chord tone memory function (ML) are selected, the key codes corresponding to the bass tones and the key codes corresponding to the chord tones are produced by the key code processing circuit 22 in the same manner as in the case where the bass tone memory function (MP) is selected. However, the signal "1" is no longer loaded in the delay flip-flop DF13 of the block data gate circuit 15 (FIG. 9) by the release of the key which has been depressed in the lower keyboard and, accordingly, the pedal keyboard signal PK representing the bass tone is not produced even if the AND gate A20 is enabled at the timing of the bass tone gate timing signal BGT. On the other hand, the storage of the delay flip-flop DF11 of the block data gate circuit 15 is self-held through the AND gate A13 which is enabled by the chord tone memory signal ML and the OR gate OR10 and the lower keyboard signal LK representing the chord tone is supplied to the channel processor 200 at the timing of the chord tone gate timing signal CGT even after release of the key. Accordingly, in the channel processor 200, the assignment of the key codes representing the chord tones is conducted and the automatic chord performance is continued, though the assignment of the key codes corresponding to the bass tones is stopped and the automatic bass performance thereby is stopped. In case the single-finger function (SF) and the bass tone memory function (MP) are selected, the chord type can be changed by changing the key depressed in the pedal keyboard just as in the case where the single-finger function (SF) and the bass tone memory function (MP) are selected so that the chord tones can be changed during the performance in accordance with the chord tone memory function (ML).

(7) A case where the custom function (CA) is selected.

In this case, the automatic bass/chord performance is made on the basis of keys depressed in the lower keyboard and a single key depressed in the pedal keyboard. Key codes representing the keys depressed in the lower keyboard are supplied directly (without being processed) to the channel processor 200 as key codes representing the chord tones and key codes representing the bass tones are formed on the basis of the single key depressed in the pedal keyboard which is used as the root note and in accordance with a chord type which is established by the keys depressed in the lower keyboard.

The operation for delivering the key codes representing the chord tones to the channel processor 200 in the case of the custom function is the same as in the case where the finger-chord function (FC) is selected.

The note code KN1–KN4 representing the keys depressed in the pedal keyboard is loaded in the delay flip-flop DF18 of the note code memory 18 (FIG. 11) under the conditions of the fourth term of the formula (13) and this note code KN1–KN4 is outputted from the gate circuit 19 if the conditions of the seventh term of the formula (15) are satisfied. At this time, the block code KB1–KB3 representing the octave is outputted from the block code gate circuit 17 (FIG. 10) and pedal keyboard signal PK representing the bass tone is outputted from the block data gate circuit 15 (FIG. 9). These operations are the same as in the case where the automatic bass/chord function (i.e., the fingered-chord function (FC), the single-finger function (SF) or the custom function (CA)) is not selected except that the condition $\overline{ABC}$ of the second term within the parenthesis of the formula (14) participates in the formation of the bass tone generation timing signal BGT when the automatic bass/chord function is not selected whereas the bass tone timing signal ABT which is condition of the first term of the formula (14) participates in the formation of the signal BGT when the custom function (CA) is selected.

The note code KN1–KN4 outputted from the note code gate circuit 19 and the block code KB1–KB3 outputted from the block code gate circuit 17 are applied to the key code processing circuit 22 where the key codes for the bass tone are formed. The operation of the key code processing circuit 22 is the same as in the case where the finger-chord function (FC) has is selected.

(8) A case where the custom function (CA) and the bass tone memory function (MP) are selected and the keys depressed in the lower keyboard and the pedal keyboard and released.

In this case, key codes representing the bass tones are formed even after release of the key with the tone of the single key which has been depressed in the pedal keyboard being used as the root tone and in accordance with the chord type constituted by the keys which have been depressed in the lower keyboard and the automatic bass tones are thereby performed. Since, however, the key-on signal concerning the keys depressed in the lower keyboard which has been stored in the key-on memory 42 of the channel processor 200 is cleared upon release of the keys depressed in the lower keyboard, the automatic chord performance is prohibited.

If the key depressed in the pedal keyboard is released after the note code KN1–KN4 representing the note of the key depressed in the pedal keyboard has been loaded in the delay flip-flop DF18 of the note code memory 18 (FIG. 11) under the condition of the fourth term of the formula (13), the conditions of the seventh term of the formula (15) are satisfied at the timing of the signal A2P even after release of the keys, if the base tone memory function (MP) has been selected. Accordingly, the bass tone gate timing signal BGT is produced at the first timing of the automatic bass/chord second processing time and the note code KN1–KN4 loaded in the delay flip-flop DF18 of the note code memory 18 is read from the note code gate circuit 19 in response to this bass tone gate timing signal BGT. The conditions of the formula (15) are satisfied even after the release of the keys because the conditions of the first term of the formula (12) are no longer satisfied if the bass tone memory function (MP) is selected and the pedal tone signal memory 36 (FIG. 14) therefore is not cleared even after the release of the keys and the signal P0 remains held in the state of "1".

At this time (i.e., at the timing of the bass tone gate timing signal BGT), the block code KB1–KB3 representing the octave of the key depressed in the pedal keyboard is outputted from the block code gate circuit 17 (FIG. 10) and the pedal keyboard signal PK representing the pedal keyboard tone (bass tone) is outputted from the block data gate circuit 15 (FIG. 9). The operations of the block code gate circuit 17 and the block data gate circuit 15 are the same as in the case where the automatic bass/chord function has been selected.

The note code KN1–KN4 outputted from the note code gate circuit 19 and the block code KB1–KB3 outputted from the block code gate circuit 17 are processed in the key code processing circuit 22 and thereafter are supplied to the channel processor 200 as the key codes corresponding to the bass tones and assigned to the predetermined tone production channels whereby the automatic bass performance is continued.

If a plurality of keys are depressed in the lower keyboard during the performance by the custom function (CA) and the bass tone memory function (MP), the automatic chord performance is made in accordance with the depressed keys. As a new chord is formed by the keys depressed in the lower keyboard, the conditions of the first term of the formula (16) are satisfied, the contents of the chord type memory 21 are rewritten and the key codes for the automatic bass/chord performance are formed in accordance with the contents of the chord type memory 21. In other words, if the chord type constituted by the keys depressed in the lower keyboard is changed, the bass tone is also changed.

(9) A case where the custom function (CA) and the chord tone memory function (ML) are selected and keys depressed in the lower keyboard and the pedal keyboard are released.

In this case, the tones of the keys which have been depressed in the lower keyboard are automatically played as the chord tones even after release of the keys. Since the bass tone gate timing signal BGT is no longer produced as will be described later, the automatic bass performance is prohibited.

If the chord tone memory function (ML) is selected, a key-on signal concerning chord tones (lower keyboard tones) stored in the key-on memory 42 of the channel processor 200 to be described later is not cleared even after release of the key depressed in the lower keyboard. Accordingly, the automatic chord performance is continued.

If the chord tone memory function (ML) is selected, the conditions of the first term of the formula (12) are satisfied, unlike the case where the bass tone memory function (MP) is selected, so that the pedal tone signal memory 36 (FIG. 14) is cleared at the timing of the signal A2P. Accordingly, the conditions of the seventh term of the formula (15) are no longer satisfied and the bass tone generation timing signal BGT is no longer produced. As the signal BGT is not produced, reading of the note code KN1–KN4 from the note code gate circuit 19 (FIG. 11), the block code KB1–KB3 from the block code gate circuit 17 (FIG. 10) and the pedal keyboard signal PK from the block data gate circuit 15 (FIG. 9) is prohibited so that generation of the key codes for the automatic bass performance is prohibited.

If a key in the pedal keyboard is depressed during the performance by the chord tone memory function, the automatic bass performance is made, using the tone of the depressed key as the root tone. Alternatively stated, if the custom function (CA) and the chord tone memory function (ML) are selected, the automatic bass performance can be independently made by depressing a single key in the pedal keyboard. In this case, the automatic bass is performed on the basis of the single key depressed which is used as the root note and in accordance with the chord type formed by the tones of the keys which were depressed in the lower keyboard.

(6) The operation of the channel processor 200

The channel processor 200 (FIG. 2) comprises a key code memory 29 which has a plurality of storage positions corresponding in number to the tone production channels (18 in the present embodiment) and assigns and stores, on a time shared basis, the key codes KC (B1–B3 and N1–N4) supplied supplied from the key code processing circuit 22 of the key coder 100 in the storage positions corresponding to the respective tone production channels, a comparison circuit 28 which compares the key code KC applied to the key code memory 29 with the key code KC* stored on a time shared basis in the key code memory 29 with respect to each channel and outputs a coincidence signal EQ when they coincide with each other, an assignment control circuit 26 for producing a load signal D which controls assignment in the key code memory 29, a truncate circuit 27 which detects a channel in which a key code of the earliest released key is stored among the key codes KC* stored in the respective channels of the key code memory 29 and, upon this detection produces a truncate signal TR assignment a new key code KC to this channel, an automatic arpeggio circuit 30 for forming a key code for the automatic arpeggio performance on the basis of the key codes KC* concerning the keys of the lower keyboard stored in the key code memory 29 and an arpeggio pattern AP1–AP4 applied from the pattern generator 4, and a timing signal generation circuit 31 for controlling the various circuits in the channel processor 200.

The truncate circuit 27, the automatic arpeggio circuit 30 and the timing signal generation circuit 31 which are not related to the subject matter of the present invention are not described in detail herein. Details of these circuits are described in the specifications of U.S. patent application Ser. No. 929,007 (now U.S. Pat. No. 4,192,211) entitled "Electronic musical instrument", Japanese Patent Application No. 106417/1977 entitled "Electronic musical instrument" and U.S. patent application No. 92,082 entitled "Electronic Musical instrument with automatic arpeggio faculty" assigned to the same assignee as the present case.

Figure 15:
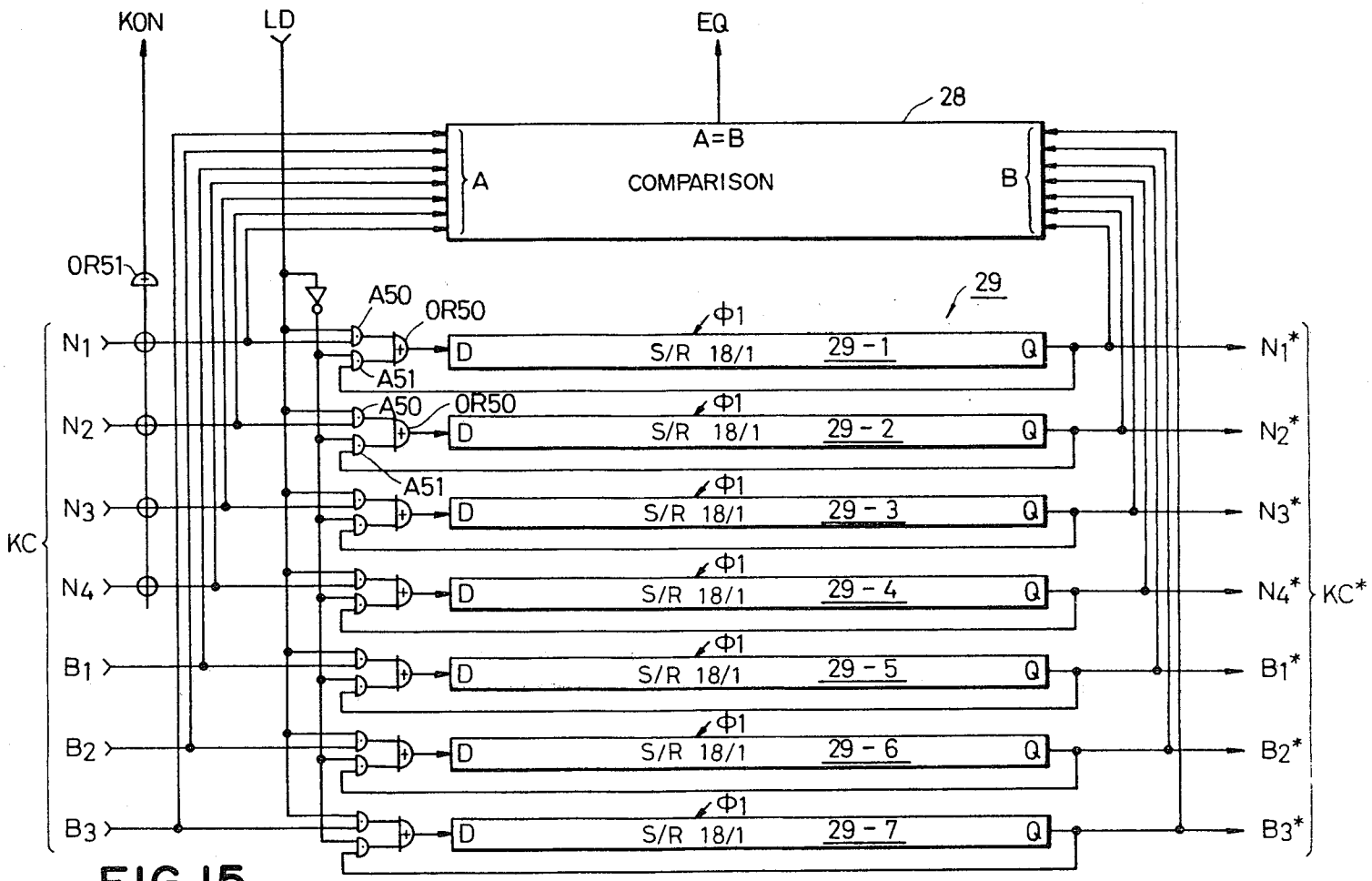
FIG. 15 is a circuit diagram showing an example of a key code memory in the channel processor.

FIG. 15 shows examples of the key code memory 29 and the comparison circuit 28. The key code memory 29 consists of seven shift registers 29-1 through 29-7 each of which is an 18-stage/1-bit shift register comprising an AND gate A50 for loading, an AND gate A51 for holdings and an OR gate OR50. The stage number of the respective shift registers 29-1 through 29-2 correspond to the tone production channels. In the present embodiment, the second, fourth, fifth, seventh, tenth, thirteenth and sixteenth channels are allotted exclusively for the upper keyboard tones, the third, sixth, eighth, ninth, eleventh, fourteenth and seventeenth channels exclusively for the lower keyboard tones, the first channel exclusively for the pedal keyboard tone, and the twelfth, fifteenth and seventeenth channels exclusively for the arpeggio tones.

The key code KC(N1–N4, B1–B3) outputted from the key code processing circuit 22 of the key coder 100 is applied to the shift registers 29-1 through 29-7 through the AND gate A50 which is enabled by the load signal LD and the OR gate OR50 and is assigned to a corresponding time slot (i.e., channel) and stored in a time sharing fashion. The shift registers 29-1 through 29-7 of the key code memory 29 are operated by a clock pulse $\phi 1$ having a period of 1 microsecond so that the key code KC* assigned to the respective tone production channels are sequentially outputted every time slot of 1 microsecond.

The comparison circuit 28 compares the key code KC applied to the key code memory 29 which does not change for 1 bit time (54 microseconds) with the key codes KC* assigned to respective channels and outputted from the key code memory 29 which changes every microsecond and, when they coincide with each other, outputs a coincidence output EQ.

Figure 16:
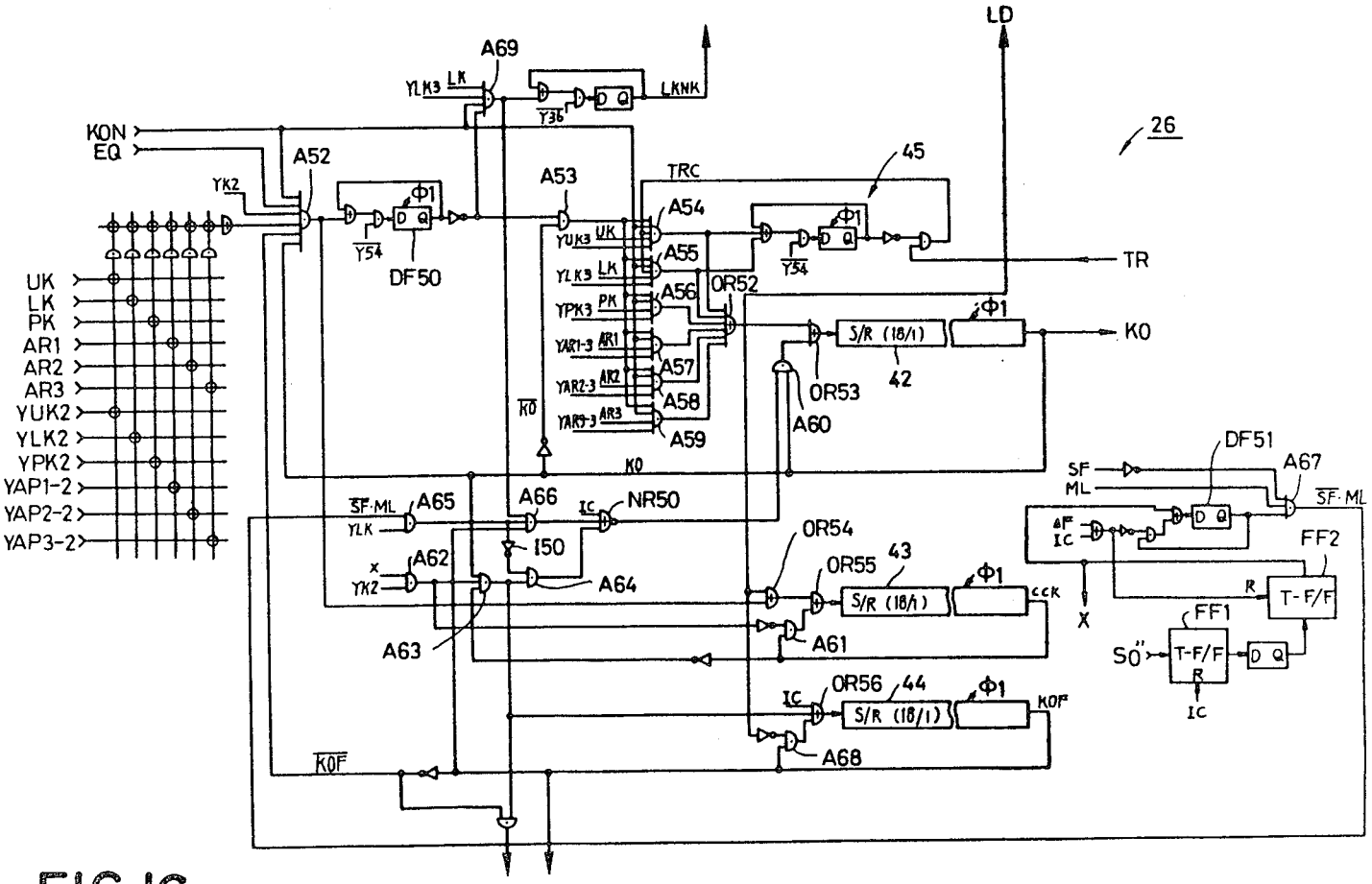
FIG. 16 is a circuit diagram showing an example of an assignment control circuit.
Figure 17:
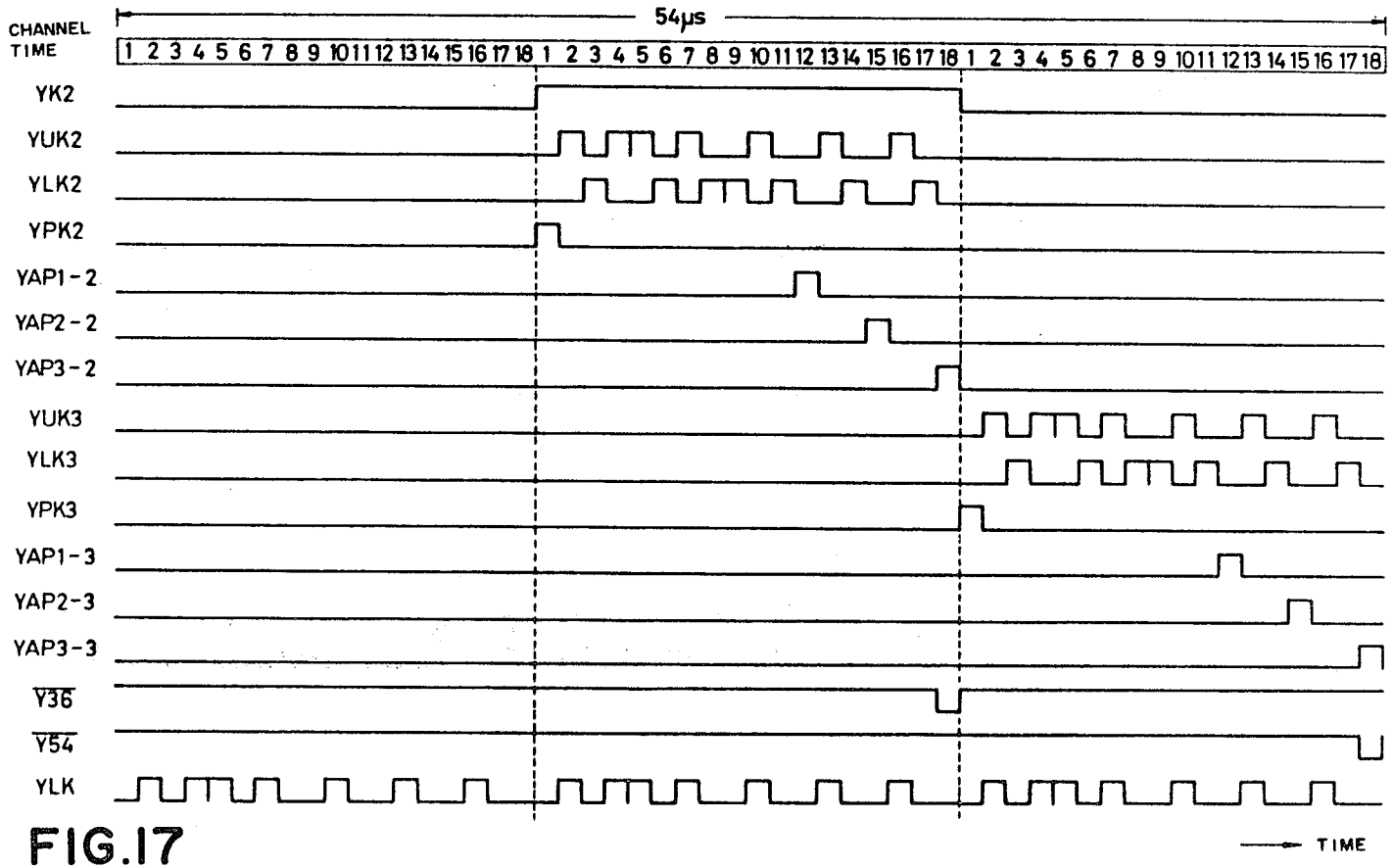
FIG. 17 is a time chart showing various timing signals generated by a timing signal generation circuit.

FIG. 16 shows an example of the assignment control circuit 26. This assignment control circuit 26 receives the keyboard indication signals UK, LK and PK, the key code detection signal KON outputted from the OR gate OR51 of the key code memory 29 (FIG. 15), the coincidence signal EQ outputted from the comparison circuit 28, the truncate signal TR outputted from the truncate circuit 27, the signal SK representing that the single-finger function (SF) is selected, the chord tone memory signal ML representing that the chord tone memory function (ML) is selected, the signal S0″ generated from the key coder 100 upon completion of each cycle of scanning of the key switches and various timing signals YK2, YUK2, YLK2, YPK2, YAP1-2, YAP2-2, YAP3-2, YUK3, YLK3, YPK3, YAP1-3, YAP2-3, YAP3-3, $\overline{Y}36$, $\overline{Y}54$ and YLK generated from the timing signal generation circuit 31 and produces the load signal LD in response to these various signals. Relation between the timing signals generated from the timing signal generation circuit 31 and the time slots corresponding to the respective tone production channels (hereinafter referred to "channel time") is shown in the time chart for FIG. 17. Processing time for each tone production assignment is 54 microseconds. This processing time is divided into the portions of the first processing time (the first 18 microseconds), the second processing time (the second 18 microseconds) and the third processing time (the third 18 microseconds). The signal YK2 represents the second processing time, the signals YUK2, YLK2 and YPK2 and the signals YUK3, YLK3 and YPK3 represent exclusive channel times of the upper keyboard tone, the lower keyboard tone and the pedal keyboard tone in the second and third processing times, the signals YAP1-2, YAP2-2 and YAP3-2 and the signals YAP1-3, YAP2-3 and YAP3-3 represent exclusive channel times of the arpeggio tones in the second and third processing times, the signal $\overline{Y}54$ is a signal which is "0" only at the last channel time (i.e., the eighteenth channel time) of the third processing time, the signal $\overline{Y}36$ is a signal which is "0" only at the last channel time (i.e., at the eighteenth channel time) of the second processing time, and the signal YLK represents exclusive channel times of the lower keyboard tone in the first, second and third processing times.

In FIG. 16, the AND gate A52 is enabled if (A) the key code KC is applied to the key code memory 29(KON="1"), (b) the key code being applied has already been assigned (EQ="1"), (c) the processing time is the second processing time (YK2="1").

(d) it is the exclusive channel time for the applied key code KC in the second processing time (UK·YUK2+LK·YLK2+PK·YPK2+AR-1·YAP1-2+AR2·YAP2-2+AP3·YAP3-2), (e) the output of the key-on memory 42 is "1" (KO="1") and (f) the output of the key-off memory 44 is "0" ($\overline{KOF}$="1").

The key-on memory 42 is composed of a shift register of 18-stages corresponding to the 18 tone production channels which stores in a time sharing fashion the key-on signal KO which becomes "1" at the channel time of the key which is being depressed among the key related to the key codes KC* assigned to the respective channels. Accordingly, if the key code KC is assigned to a certain tone production channel, the key-on signal ("1") is outputted at the channel time corresponding to that the production channel. The key-off memory 44 is composed, like the key-on memory 42, of a shift register of 18 stages corresponding to the 18 tone production channels and stores, in a time sharing manner, the key-off signal KOF which becomes "1" if one of the keys related to the key codes KC* assigned to the respective tone production channels has been released.

If the AND gate A52 is enabled, this means that the key code KC which is being applied to the key code memory 29 has already been assigned. The output "1" of the AND gate A52 is held in a delay flip-flop DF50 by a signal Y54 thereby to disable an AND gate A53 for prohibiting the assignment of this key code KC.

If the AND gate A52 is not enabled, the output of the delay flip-flop DF50 is "0" and a signal "1" which is produced by inverting the output of the delay flip-flop DF50 is applied to AND gates A54–A59 through the AND gate A53 which is enabled by a signal $\overline{KO}$ produced by inverting the output of the key-on memory 42. To the AND gates A54–A59 is commonly applied the key code detection signal KON. To the other input of the AND gate A54 are applied the upper keyboard signal UK, the signal YUK3 and a truncate designation signal TRC outputted from the truncate priority circuit 45. To the other input of the AND gate A55 are applied the lower keyboard signal LK, the signal YLK3 and the truncate designation signal TRC. To the other input of the AND gate A56 are applied the pedal keyboard signal PK and the signal YPK3. To the other inputs of the AND gate A57–A59 are applied arpeggio signals AR1–AR3 representing the arpeggio tones (outputted from the key coder 100) and the signals YAP1-3, YAP2-3 and YAP3-3.

The truncate designation signal TRC outputted from the truncate priority circuit 45 is used for assigning key code KC of an upper keyboard tone or a lower keyboard tone to a single channel among the seven channels exclusively allotted to the upper keyboard tones and the lower keyboard tones. This priority circuit 45 outputs the truncate signal TR generated by the truncate circuit 27 (generated in synchronism with the channel time of the earliest released key in the upper keyboard and the channel time of the earliest released key in the lower keyboard among the tones which are presently assigned) as the truncate designation signal TRC until a signal "1" is outputted from the AND gate A54 or A55. If a signal "1" is outputted from the AND gate A54 or A55, the priority circuit 45 subsequently blocks the truncate signal TR and does not output the truncate designation signal TRC. Accordingly, the AND gate A54 or A55 is enabled only once in the third processing time.

Accordingly, one of the AND gates A54–A59 is enabled at a single channel time among the channel times exclusively allotted to the keyboard for the key code KC applied thereto and outputs a signal "". The output of the AND gates A54–A59 is applied to the loading AND gate A50 of the key code memory 29 as the load signal LD through the OR gate OR52. The key code memory 29 performs assignment of the key codes to the tone production channels by loading the key codes KC applied at the timing of the load signal LD.

The load signal LD outputted from the OR gate OR52 is applied to the key-on memory 42 through an OR gate OR53 and stored in a time sharing fashion as the key-on signal KO through an AND gate A60. The output of the OR gate OR52 is applied to a key-on temporary memory 43 through OR gates OR54 and OR55. The output of the AND gate A52 also is applied to the key-on temporary memory 43 through the OR gates OR54 and OR55. The key-on temporary memory 43 is composed, like the key-on memory 42, of a shift register of 18 stages corresponding to the 18 channels and stores the applied signal (the output of the OR gate OR52 or the output of the AND gate A52) in a time sharing manner through an AND gate A61.

The key-on temporary memory 43 is provided for detecting key-off (stopping of generation of the key code KC), The key-on temporary memory 43 is cleared periodically by an output of the AND gate A62 which is enabled by a key-off examination signal X and the signal YK2. The key-off examination signal X is obtained by frequency dividng the signal S0" (generated by the control signal generation circuit 24 of FIG. 14) by four by flip-flops FF1 and FF2.

Accordingly, the contents of the key-on temporary memory 43 corresponding to the respective channels are cleared if the key has been released (i.e., if the generation of the key code KC in the key coder 100 is stopped) whereas a signal "1" is stored again in response to the output of the AND gate A52 if the key is being depressed (i.e., if the key code KC is being generated from the key coder 100) so that the contents of the memory 43 are not cleared.

If the storage of the key-on temporary memory 43 is cleared and the output CCk of the key-on temporary memory 43 becomes "0", the AND gate A63 is enabed under conditions that the output KO of the key-on memory 42 is "1" and the output of the AND gate A62 is "1". The output of the AND gate A63 (representing the key-off) is applied to an AND gate A64. The AND gate A64 receives at the other input thereof a signal produced by inverting by an inverter I50 an output of an AND gate AN65 which in turn is enabled by the signal $\overline{SF}$·ML and the signal YLK. The signal $\overline{SF}$·ML is an output of AND gate AN67 which is enabled upon receipt of a signal produced by inverting the signal SF representing that the signal finger function has been selected, the signal ML representing that the chord tone memory function, (ML) has been selected and the output of a delay flip-flop DF51 which holds the signal X produced by frequency dividing the signal So" by four under the condition that the signal ΔF and the initial signal IC are both "0". The output of the delay flip-flop DF51 is used as one of the conditions of the AND gate A67 for removing adverse effects of chattering caused by the function switches.

Accordingly, the AND gate A64 is enabled under the condition $\overline{SF}\cdot\overline{ML}\cdot\overline{YLK}$ to deliver its output to an AND gate A60 through a NOR gate NR50. The AND gate A60 thereby is disabled and the storage in the corresponding channel of the key-on memory 42 is cleared and the key-on signal KO of this channel becomes "0".

The key-off signal KOF which is the output of the AND gate A63 is applied to the key-off memory 44 through an OR gate OR56 and stored therein through an AND gate A68.

The above description has been made about the case where the condition $\overline{SF}\cdot\overline{ML}$ has been satisfied, i.e., the single finger function (SF) has been selected or the chord tone memory function (ML) has not been selected. If the condition $\overline{SF}$·ML is satisfied, i.e., the finger-chord function (FC) and the chord tone memory function (ML) are selected or the custom function (CA) and the chord tone memory function (ML) are selected, the storage in the key-on memory 42 concerning the key which has been released in the lower keyboard is not cleared even after release of the key. This is because the output of the inverter I50 is turned to "0" upon satisfaction of the condition $\overline{SF}$·ML and the AND gate A64 thereby is disabled.

If the condition $\overline{SF}$·ML is satisfied, the output KOF of the key-off memory 44 is "1" and the AND gate A66 is enabled when the AND gate A69 which is enabled by the key code detection signal KON and the signals YLK3 and LK produces an output "1" (i.e., a key has been depressed newly in the lower keyboard). The key-on memory 42 is cleared by the output of this AND gate A66 and the key-on signal KO thereby becomes "0". The output of the AND gate A69 is held by the signal Y36 and is delivered to the key coder 100 as the lower keyboard new key-on signal LKNK.

If the single-finger function (SF) and the bass tone memory function (MP) are selected as the automatic bass-chord function and the key depressed in the lower keyboard is released, the key codes KC representing the chord tones are generated from the key coder 100 but the lower keyboard signal LK which indicates that the key codes KC represent the chord tones is not generated. In this case, the AND gates A52 and A55 are not enabled even if the key codes KC representing the chord tones are applied thereto so that the key-on signal KO with respect to these key codes KC is "0".

If one of the fingered-chord function (FC), the single-finger chord function (SF) and the custom function (CA) is selected and further the chord tone memory function (ML) is selected and the keys depressed in the lower keyboard are released, the key codes KC corresponding to the bass tones are produced by the key coder 100 but the pedal keyboard signal PK indicating that these key codes KC represent the bass tones is not produced. In this case, the AND gates A52 and A56 are not enabled so that assignment of the key codes KC corresponding to the bass tones is not effected.

The key codes KC* which have been assigned to the respective tone production channels in the channel processor 200 and the key-on signal KO are supplied to the tone generation circuit section 3. The tone generation circuit section 3, which is not described in detail here, has tone production channels corresponding to those of the channel processor 200 and generates corresponding tone signals (including chord tones and bass tones) in response to the key codes KC assigned to the respective channels and controls the generated tone signals (i.e., envelope controlling) in accordance with the key-on signal KO.

As described in the foregoing, according to the present invention, the automatic performance can be made in accordance with a memory function independently from the bass tones and the chord tones so that the automatic performance can be conducted with richer variety. If, for example, the custom function (CA) and the chord tone memory function (ML) are selected and the keys depressed in the lower keyboard are released, the automatic chord performance is conducted in accordance with the keys which have been depressed in the lower keyboard and if a key is depressed in the pedal keyboard during the automatic performance by the chord tone memory function, an automatic bass performance can be made independently with the tone of this key depressed in the pedal keyboard being used as the root note.

What is claimed is:

1. In an electronic musical instrument, the improvement comprising:

keys for playing notes of the instrument;

a key detection circuit coupled to said keys for producing per each of depressed ones of said keys a key code which represents a name of the key;

a tone generator circuit including a plurality of tone production channels respectively for generating musical tone signals as designated by the key codes supplied thereto;

a key code memory having storage positions corresponding in number to said tone production channels and storing key codes of the depressed keys in a certain subset of said storage positions, and a circuit for providing a key-on signal for the duration that each key code is supplied to said key code memory;

a key-on memory for storing the respective key-on signal for each corresponding storage position of said key code memory;

a root note memory storing a key code of a single key corresponding to a root note among the keys depressed in the keyboard;

means for producing key codes for bass tones in accordance with contents stored in said root note memory and for producing a bass indication signal which indicates that these key codes are for the bass tones;

an automatic performance circuit for supplying said key codes for bass tones to said key code memory in a rhymic pattern, said bass indication signal causing said supplied bass tone key codes to be entered into storage positions in said key code memory of other than said certain subset;

first means for selecting a chord tone memory function, second means, independent of said first means, for selecting a bass tone memory function, means for maintaining storage, in the positions of said key-on memory corresponding to said certain subset of storage positions, of signals indicating the on-state after release of said each keys under the condition that the chord tone memory function is selected, and means for continuing the production of said bass tone key codes and bass indication signal after release of the depressed keys under the condition that the bass tone memory function is selected, whereby automatic generation of a chord designated by said key codes stored in said key code memory continues after key release when said chord tone memory function is selected, and whereby automatic bass tone generation continues after key release when said bass tone memory function is selected.

2. In an electronic musical instrument of the type having an automatic accompaniment device, the improvement comprising:

keys for playing notes of the instrument;

a key detection circuit coupled to said keys for producing per each of depressed ones of said keys a key code which represents a name of the key;

a tone generator circuit including a plurality of tone production channels respectively for generating musical tone signals as designated by key codes supplied thereto;

a root note memory storing a key code of a single key among said depressed keys;

means for producing key codes for chord tones based on said stored root note and for producing a chord indication signal indicating that the key codes are for chord tones;

means for producing key codes for bass tones and for producing a bass indication signal indicating that these key codes are for bass tones;

an automatic performance circuit delivering said produced key codes for chord tones and said produced key codes for bass tones in a rhythmic pattern to said tone generator circuit, said chord indication signal causing utilization by said tone generator circuit of said key codes for chord tone only in certain ones of said tone production channels, said bass indication signal causing utilization by said tone generator circuit of key codes for bass tones only in tone production channels other than said certain ones;

first means for selecting a chord tone memory function, second means, independent of said first means, for selecting a bass tone memory function, means for holding said chord indication signal after release of the depressed key under the condition that the chord tone memory function is selected, and means for holding said bass indication signal after release of the depressed key under the condition that said bass tone memory function is selected, whereby independent, continued generation of chord tones and bass tones proceeds after key release depending respectively on whether said chord tone memory function or said base tone memory function, or both, are selected.

3. In an automatic accompaniment system for a keyboard electronic musical instrument of the type in which musical tones are generated in a tone generator in accordance with note codes provided thereto, the improvement comprising:

a key code processor for selectively either directly providing supplied note codes to said tone generator or modifying a supplied root note code to produce therefrom note codes for automatic chord or automatic bass performance, said produced automatic performance note codes being provided to said tone generator, a keyboard scanning circuit for cyclicly scanning the keys of said keyboard and producing during such scanning note codes of depressed keys, a note code memory circuit, connected to said keyboard scanning circuit, and operative in a first mode for passing said produced note codes directly to said key code processor while said scanning is progressing and operative in a second mode, after said scanning, for storing a root note code for subsequent supply to said key code processor, mode selection means for selecting one or more independent modes of operation of said accompaniment system including a chord memory mode in which chord tones are automatically generated after key release and a bass tone memory mode in which bass tones are generated after key release, control signal generation means, cooperating with said mode selection means, for providing a first control signal to said note code memory circuit to enable storage therein of said root note code and for providing to both said note code memory circuit and said key code processor a bass gate signal if said bass tone memory mode is selected and a chord gate signal if said chord memory mode is selected, either of said bass gate and said chord gate signals causing the stored root note code to be supplied from said note code memory circuit to said key code processor, said bass gate and chord gate signals respectively enabling said note code processor to modify said root note code so as to produce therefrom respective automatic bass performance and automatic chord performance note codes, and wherein said mode selection means facilitates selection of a fingered chord mode in which the notes of a chord are selected by depression of plural keys, the key codes for such plural depressed keys being passed by said note code memory circuit and directly provided by said key code processor to said tone generator, together with:

key on-off memory means, associated with said tone generator, for storing signals indicating the depressed or released state of keys for which note codes are being supplied to said tone generator, said control signal generation means, in response to selection by said mode selection means of said chord memory mode while said fingered chord mode also is selected, producing certain control signals causing said key on-off memory means to retain therein, after corresponding key release, signals indicating that said plural keys are still depressed, whereby said notes of a chord will continue to be generated by said tone generator after key release.

4. An accompaniment system according to claim 3 further comprising:

a chord detector operative during a cycle of said keyboard scanning circuit following the scanning of said keys and enabled by certain control signals produced by said control signal generation circuit in response to selection of a mode in which constituent notes of a chord are selected by plural key depression, said chord detector when enabled determining the presence of a chord and the chord type in response to the note codes of depressed keys produced by said keyboard scanning circuit during said scanning, and a chord type memory, enabled by said certain control signals, for storing, concurrently with storage of said root note code by said note code memory circuit, a signal indicating the chord type detected by said chord detector, said stored chord type indicating signal being used by said key code processor in conjunction with said supplied root note code to produce said automatic performance note codes.

5. An automatic accompaniment device for a keyboard electronic musical instrument of the type having a tone generator with a small plurality of tone generation channels, each channel generating a musical tone specified by a key code supplied thereto, and a channel processor containing a key code memory for storing key codes for supply to said tone generator and containing a key on-off memory for storing for each key code in said key code memory a signal indicative of the depressed or released state of the keyboard key to which that key code corresponds, said device comprising:

function switches for selecting one or more of a plurality of accompaniment modes including automatic chord generation and automatic bass tone generation, and including separate switch means for independently selecting a chord memory mode and/or a bass tone memory mode, control signal generation means, connected to said function switches, for providing separate control signals indicative of each selected mode, a key scanning means, operative during cyclical scanning cycles, for providing key codes indicative of depressed keys in one or more selected keyboards, first circuit means, operative in response to the control signal provided by said control signal generation means upon selection of the chord memory mode, for maintaining the contents of said key on-off memory after release of the keys in a selected keyboard for which the key codes have been stored in said key code memory, said maintained contents of said key on-off memory thereby causing said tone generator to continue generation of the chord corresponding to said depressed keys after release of said keys, a key code processing and data generation means, responsive to a root note code and to a chord type indicating signal and to appropriate enabling control signals, for producing therefrom respective key codes for automatic chord or automatic bass tone production, a root note code memory, a chord type memory, second circuit means, operative in response to the control signal provided by said control signal generation means upon selection of a "single finger" automatic chord mode, for causing entry into said root note code memory of a key code corresponding to a single depressed key, for causing entry of a chord type signal into said chord type memory, and for causing said key code processing and data generation means to utilize as the root note code the key code stored in said root note code memory and to utilize the chord type indicating signal from said chord type memory to produce automatically key codes corresponding to a chord and to supply these key codes to said key code memory in said channel processor, and third circuit means operative in response to the control signal provided by said control signal generation means upon selection of a bass tone memory mode, for causing entry into said root note code memory and into said chord type memory respectively of a root note code and of a chord type indicating signal, and causing said key code processing and data generation means to utilize the root note code and chord type indicating signals from said respective memories to produce in rhythmic order a set of key codes for automatic bass production, and to provide this set of key codes to the key code memory of said channel processor.

6. In a keyboard electronic musical instrument of the type in which musical tones are produced by a tone generator having plural tone generation channels in response to key codes supplied from a channel processor in which such key codes are stored in storage positions corresponding to said channels, an automatic accompaniment system comprising:

first means for entering and storing key codes for depressed plural keys representing a chord into certain positions of said channel processor, thereby enabling fingered chord production, second means for inhibiting the effective deletion of said chord representing key codes from said channel processor certain positions after release of said plural keys, thereby enabling continued fingered-chord production after key release, third means for providing to said channel processor certain positions chord related key codes formed automatically from a single depressed key related root note code and a chord type designating signal, thereby enabling single-finger automatic chord production, fourth means for retaining storage of said root note code and for continuing formation and provision to said channel processor certain positions of said chord related key codes after release of said single key, thereby enabling continued single-finger automatic chord production, fifth means for providing to at least one storage position said channel processor other than said certain positions, in rhythmic order, a set of bass tone designating key codes automatically obtained from a stored root note code corresponding to a depressed key and a chord type designating signal, thereby enabling automatic bass tone production, sixth means for retaining storage of said root note code and for continuing the obtaining and provision to said at least one storage position of bass tone designating key codes after release of said depressed key, thereby enabling continued automatic bass tone production, and mode selection means for selectively producing signals for separately and independently actuating one or more of said first through sixth means.

7. In a keyboard electronic musical instrument of the type including a tone generator having plural tone production channels for producing musical tones in response to key codes supplied thereto from a channel processor in which said key codes are stored in storage positions corresponding to said channels, an automatic accompaniment system comprising:

a depressed key detection circuit for producing key codes identifying depressed keys, said produced key codes being supplied to a certain subset of said channel processor storage positions for fingered chord production, root note determination circuitry, cooperating with said depressed key detection circuit, for determining, from among one or more depressed keys, a root note to be used as the basis for automatic single-finger chord and automatic bass tone production, a root note code memory configured to store as a root note code the key code of the depressed key representing such root note, key code processing and data generation means for producing in rhythmic order key codes for automatic single-finger chord and automatic bass tone production based on the stored root note code, such produced key codes being supplied to said certain subset of storage positions in said channel processor for automatic chord production and to at least one other different storage position for automatic bass production, means for producing a key-on signal each time a key code is entered into said channel processor a key-on memory for storing said key-on signals on a channel-by-channel basis corresponding to the key codes in said channel processor, the envelope of each tone being established in said tone generator in response to the state of the stored key-on signal corresponding to the channel in which said each tone is generated, a fingered chord memory mode selection means operative, when selected, for maintaining storage of the key-on signals associated with depressed key codes for a fingered chord upon release of the corresponding keys, so that the fingered chord tones continue to be produced even after release of the corresponding keys, and automatic single-finger chord and automatic bass memory mode selection means operative, when selected, for maintaining production in said key code processing and data generation means of the key codes for single-finger chord and automatic bass tone production based on the root note code stored in said root note code memory after release of said depressed keys.

* * * * *